US008851167B2

(12) United States Patent
Eriksen

(10) Patent No.: US 8,851,167 B2
(45) Date of Patent: Oct. 7, 2014

(54) MECHANICAL LINER DRILLING CEMENTING SYSTEM

(75) Inventor: Erik Peter Eriksen, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 624 days.

(21) Appl. No.: 13/041,079

(22) Filed: Mar. 4, 2011

(65) Prior Publication Data

US 2012/0222861 A1 Sep. 6, 2012

(51) Int. Cl.

| | |
|---|---|
| ***E21B 33/12*** | (2006.01) |
| ***E21B 23/00*** | (2006.01) |
| ***E21B 23/02*** | (2006.01) |
| ***E21B 7/20*** | (2006.01) |
| ***E21B 23/06*** | (2006.01) |
| ***E21B 43/10*** | (2006.01) |

(52) U.S. Cl.

CPC . *E21B 7/20* (2013.01); *E21B 23/06* (2013.01); *E21B 43/10* (2013.01)

USPC ..... 166/181; 166/124; 166/208

(58) Field of Classification Search

USPC ..... 166/382, 290, 123, 124, 208, 181, 182

See application file for complete search history.

(56) References Cited

U.S. PATENT DOCUMENTS

| | | | | | |
|---|---|---|---|---|---|
| 3,047,071 | A | * | 7/1962 | Davis | 166/124 |
| 4,388,971 | A | * | 6/1983 | Peterson | 166/387 |
| 4,603,743 | A | * | 8/1986 | Lindsey, Jr. | 166/382 |
| 4,846,281 | A | * | 7/1989 | Clary et al. | 166/373 |
| 5,048,606 | A | * | 9/1991 | Allwin | 166/208 |
| 5,207,274 | A | * | 5/1993 | Streich et al. | 166/382 |
| 5,343,954 | A | * | 9/1994 | Bohlen et al. | 166/382 |
| 5,425,423 | A | | 6/1995 | Dobson et al. | |
| 5,433,275 | A | * | 7/1995 | Melenyzer et al. | 166/380 |
| 5,697,449 | A | * | 12/1997 | Hennig et al. | 166/382 |
| 5,813,458 | A | * | 9/1998 | Smith et al. | 166/182 |

(Continued)

FOREIGN PATENT DOCUMENTS

| | | | |
|---|---|---|---|
| CA | 2311160 | A1 | 12/2001 |
| CA | 2538196 | | 8/2006 |
| WO | WO2004/053288 | A1 | 6/2004 |

OTHER PUBLICATIONS

Weatherford "R Running Tool with Hydraulically Released Mechanical Lock", 2006, pp. 1-2.

(Continued)

*Primary Examiner* — Kenneth L Thompson
*Assistant Examiner* — Michael Wills, III
(74) *Attorney, Agent, or Firm* — Osha Liang LLP

(57) ABSTRACT

A packer setting tool sets a liner top packer by mechanical rotation of the running tool and set down weight following cementing of a liner. The packer setting tool includes a tubular release body mounted on an end of the running tool. An annular dog sub circumscribes a portion of the release body. The dog sub is linked to the release body with a shear screw. A thread on an outer surface of the release body engages a thread on an inner surface of the dog sub to define a threaded connection between the dog sub and the release body. When the running tool rotates, the thread on the release body rotates with respect to the thread on the dog sub driving the release body in an axial direction fracturing the shear screw and urges an adapter sleeve against the packer assembly to set the packer assembly.

17 Claims, 16 Drawing Sheets

(56) References Cited

U.S. PATENT DOCUMENTS

| | | | | |
|---|---|---|---|---|
| 6,009,943 | A * | 1/2000 | Yokley et al. | 166/125 |
| 6,241,023 | B1 * | 6/2001 | Krauss et al. | 166/387 |
| 6,675,890 | B2 * | 1/2004 | Pietrobelli et al. | 166/124 |
| 6,739,398 | B1 | 5/2004 | Yokley et al. | |
| 7,013,997 | B2 | 3/2006 | Vail, III | |
| 7,036,610 | B1 | 5/2006 | Vail, III | |
| 7,040,420 | B2 | 5/2006 | Vail, III | |
| 7,048,050 | B2 | 5/2006 | Vail, III et al. | |
| 7,083,005 | B2 | 8/2006 | Galloway et al. | |
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,084 | B2 | 9/2006 | Vail, III | |
| 7,147,068 | B2 | 12/2006 | Vail, III | |
| 7,165,634 | B2 | 1/2007 | Vail, III | |
| 7,178,609 | B2 | 2/2007 | Hart et al. | |
| 7,225,880 | B2 | 6/2007 | Braddick | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,360,594 | B2 | 4/2008 | Giroux et al. | |
| 7,367,410 | B2 | 5/2008 | Sangesland | |
| 7,395,882 | B2 | 7/2008 | Oldham et al. | |
| 7,624,818 | B2 | 12/2009 | McClain et al. | |
| 7,647,990 | B2 | 1/2010 | Tessari et al. | |
| 7,766,088 | B2 | 8/2010 | Sessions et al. | |
| 7,784,552 | B2 | 8/2010 | Brouse | |
| 7,798,251 | B2 | 9/2010 | Eriksen et al. | |
| 7,845,431 | B2 | 12/2010 | Eriksen et al. | |
| 2001/0017210 | A1 | 8/2001 | Howlett | |
| 2006/0196695 | A1 | 9/2006 | Giroux et al. | |
| 2007/0267221 | A1 | 11/2007 | Giroux et al. | |
| 2009/0101345 | A1 | 4/2009 | Moffitt et al. | |
| 2009/0107675 | A1 | 4/2009 | Eriksen et al. | |
| 2010/0126734 | A1 | 5/2010 | Eriksen | |
| 2011/0203794 | A1 * | 8/2011 | Moffitt et al. | 166/285 |

OTHER PUBLICATIONS

Drilling Contractor "Liner Drilling Technology Being Prepared for Offshore", Jan./Feb. 2004. pp. 14-15.

Dril-Quip LS-15 Liner Hanger System, Sales Manual, pp. 5-7.

TIW "Liner Equipment" HLX Liner-Top Packer, pp. 5, 9-11, 18-19.

Dril-Quip "LS-15 Liner Hanger System", pp. 1-2, 4 and 6.

U.S. Appl. No. 61/176,779, filed May 8, 2009.

U.S. Appl. No. 61/307,238, filed Feb. 23, 2010.

World Oil/Oct. 1999—Drilling Technology "Casing-While-Drilling: The Next Step Change in Well Construction", pp. 34-36 and 38-40.

Rotary Steerable Drilling with Liner—during 2007 or later based on the text—Randi Elisabeth Hugdahl, Leader, TNE RD RCT DWPT—pp. 3-5.

* cited by examiner

MECHANICAL LINER DRILLING CEMENTING SYSTEM

BACKGROUND OF THE INVENTION

1. Field of the Invention

The present invention relates in general to a method and system for cementing a liner and, in particular, to a system and method for cementing a liner and setting a liner top packer with a mechanical setting tool.

2. Brief Description of Related Art

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than an inner string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tie back string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner, and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. This method is similar to a related technology known as casing drilling. Retrievable bottom hole assemblies are known for casing drilling, but in casing drilling the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. With liner drilling, the operator sets a liner hanger, releases a liner hanger running tool, and then retrieves the inner string. The liner can then be cemented using a cement retainer set on the drill pipe and run into the wellbore. A valve in the retainer then closes and holds the cement below the retainer and behind the liner. Unfortunately, this method does not allow for testing of the casing or liner.

A liner top packer is often used to isolate the top of the liner from the wellbore. The liner top packer is set by two drill pipe runs. The first run cleans the liner top, and the second deploys and sets the liner top packer. Unfortunately, this is a time consuming and expensive process due to the additional run requirements needed to first retrieve the bottom hole assembly, then set and cement the liner, and finally to set the liner top packer.

A displacement plug may be used to prevent cement in the annulus between the liner and wellbore or casing from backflowing into the liner during setting of the liner top packer: Conventional methods for setting a liner top packer include use of float shoes and float collars. In these methods, plug failure is not an issue because the float equipment will take over in the event there is a plug failure. However, where the liner is drilled with retrievable equipment, there is no float equipment to backup the displacement plug. Where the displacement plug fails to latch, fluid pressure must be maintained on the cement to prevent backflow. Conventional packer setting tools set the liner top packer by pulling upward on the packer setting tool and releasing any downward force on the liner top packer until dogs in the packer setting tool move into position over a setting sleeve of the liner top packer. Where the displacement plug fails to latch, the process of setting the packer relieves the pressure on the cement allowing it to backflow. In addition, releasing the drill string weight from the liner top packer may cause the liner top packer to move out of position relative to the liner top. Therefore, there is a need for a mechanical liner top packer setting tool that overcomes the cost, time, and reliability problems of prior art methods.

SUMMARY OF THE INVENTION

These and other problems are generally solved or circumvented, and technical advantages are generally achieved, by embodiments of the present invention that provide a mechanical liner drilling cementing assembly, and a method for using the same.

In accordance with an embodiment of the present invention, a packer setting tool for use with a running tool comprises a tubular release body mounted on an end of the running tool and insertable into a wellbore. The packer setting tool also includes an annular dog sub supported within the wellbore. The dog sub circumscribes a portion of the release body and is linked to the release body with a shear screw. A thread on an outer surface of the release body engages a thread on an inner surface of the dog sub to define a threaded connection between the dog sub and the release body. A tubular adapter sleeve mounts on an outer surface of the release body and has an end configured to interfere with a packer assembly. When the running tool rotates, the thread on the release body rotates with respect to the thread on the dog sub and drives the release body in an axial direction. This fractures the shear screw and urges the adapter sleeve against the packer assembly to set the packer assembly.

In accordance with another embodiment of the present invention, a system for cementing a liner string suspended from an end of a wellbore casing string by a liner hanger, and setting a liner top packer in the casing string above the liner hanger comprises a running tool, a packer setting tool, a liner top packer, a double flapper valve, and a tie back nipple. The running tool defines a central bore for passage of cement and drilling mud, the central bore having an axis. The packer setting tool couples to the running tool so that rotation of the running tool will actuate the packer setting tool to set the liner top packer with the running tool and upwards axial pull will actuate the packer setting tool to release the packer setting tool from the liner top packer. The liner top packer releasably mounts to the packer setting tool at an upper end of the liner top packer. The double flapper valve couples to a lower end of the liner top packer so that after removal of the packer setting tool from the well bore the double flapper will prevent fluid flow in two directions through the valve. The tie back nipple couples to a lower end of the double flapper valve and is configured to engage a liner top.

In accordance with yet another embodiment, a method for cementing a liner string suspended from an end of a wellbore casing string by a liner hanger, and setting a liner top packer in the casing string above the liner hanger is disclosed. The method comprises running a running tool assembly having a running tool, a packer setting tool, a liner top packer in an unset position, a double flapper valve in an open position, and a tie back seal nipple into engagement with a liner top. Next, the method pumps cement through the running tool assembly into a liner annulus between the liner and a native formation, and then, the method pumps a wiper plug down the running tool assembly. The method then sets the liner top packer by rotating the running tool assembly relative to the packer setting tool while maintaining a downward force on the liner top packer. The running tool and packer setting tool are removed from the wellbore and, in so doing, move the double flapper valve to a closed position.

An advantage of embodiments disclosed herein is that the present system allows use of existing liner cement plugs and provides a back up flow barrier to a latch down plug. This is needed in the event the pumps are stopped before the plug reaches its landing receptacle or in the event the plug fails. It provides a reliable, cost effective means to effectively cement drilled in liners while reducing the number of trips required to cement the liner. The present system also eliminates the need for a wiper plug to latch and hold back cement, reducing the risk of cement backflow while setting the packer.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiments thereof which are illustrated in the appended drawings, which drawings form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, materials, and the like have been omitted inasmuch as such details are not considered necessary to obtain a complete understanding of the present invention, and are considered to be within the skills of persons skilled in the relevant art.

Figure 1A:
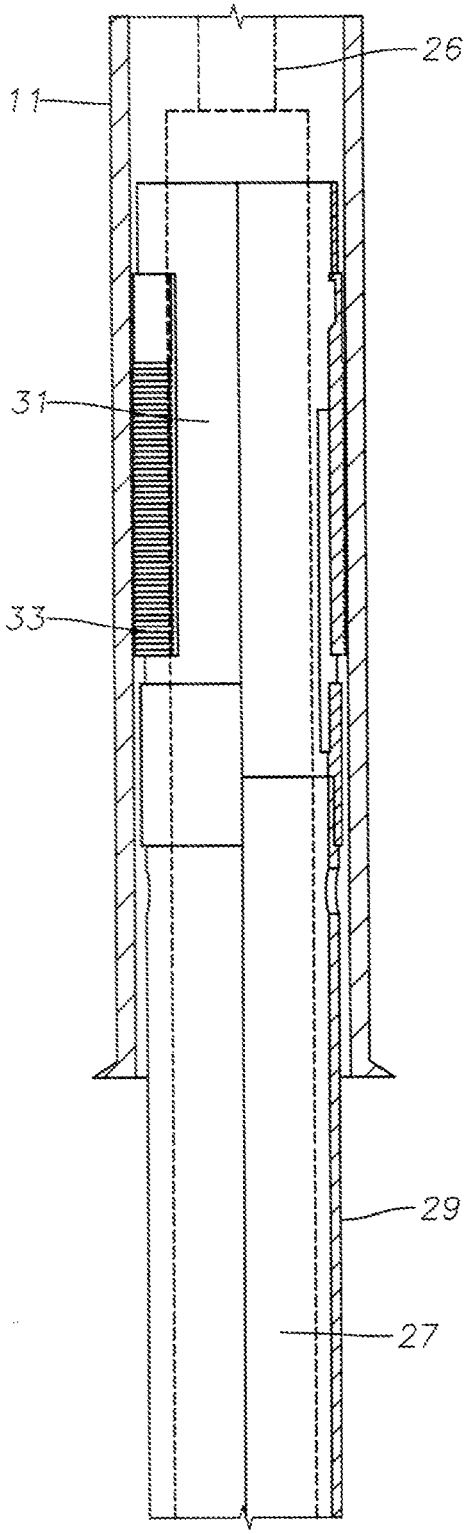
FIGS. 1A, 1B, and 1C are exemplary schematic sectional views of inner and outer concentric strings during drilling.
Figure 1B:
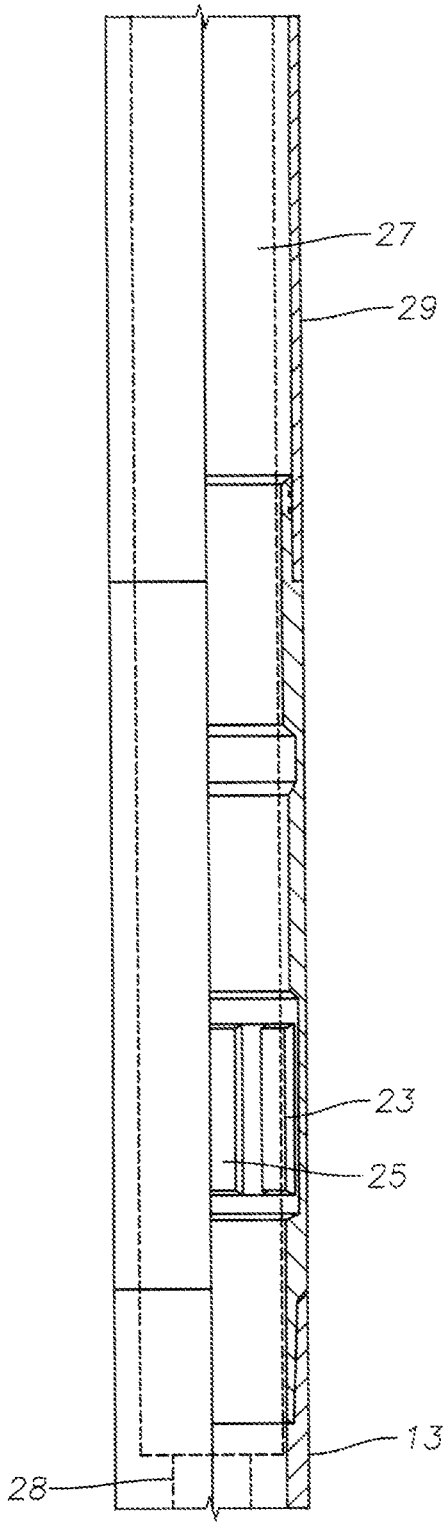
Figure 1C:
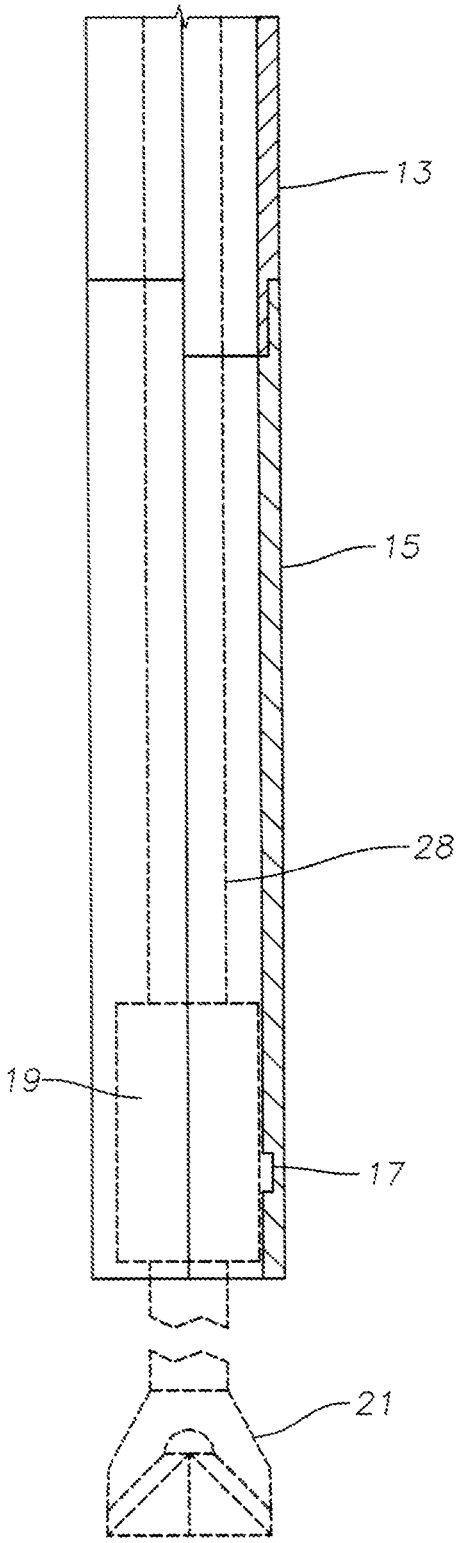

Referring to FIGS. 1A, 1B and 1C, a string of casing 11 has been previously installed and cemented in the wellbore. A liner string 13 extends down from casing string 11 optionally to the total depth of the wellbore. In the example, the term "liner string" refers to a string of well pipe that does not extend all the way up to the wellhead, rather it will be cemented in the wellbore with its upper end a short distance above the lower end of casing string 13. The terms "casing" and "liner" may be used interchangeably. In this embodiment, liner string 13 will normally have been deployed by drilling the wellbore at the same time the liner string 13 is being lowered into the well.

Referring to FIG. 1C, a bottom hole sub 15 is secured into the liner string 13 near the lower end of liner string 13. A cementing plug profile 17, defined by the groove in an inner surface of sub 15, is optionally located near the lower end of casing string 13. A bottom hole assembly (BHA) 19 is shown in FIG. 1C. BHA 19 is shown in dotted lines, as described below it will be retrieved in this example before the cementing occurs. BHA 19 may include a drill bit 21 and an assembly (not shown) that will latch BHA 19 into bottom hole sub 15 to support BHA 19 both axially and to transmit torque between BHA 19 and bottom hole sub 15. BHA 19 may include additional equipment, such as an underreamer (not shown) and optionally surveying instruments and directional drilling equipment.

Referring to FIG. 1B, liner string 13 also includes a torque sub 23, which is near the upper end of liner string 13 in this embodiment. Torque sub 23 may be an integral portion of liner string 13, or alternatively a separate member secured to a portion of liner string 13. Torque sub 23 has an internal profile 25, such as vertical splines. Internal profile 25 is of a sufficient size and strength such that torque applied by a liner running tool 27, may transfer to torque sub 23 and liner string 13 through internal profile 25. Liner running tool 27 releasably secures a string of drill pipe 26 (FIG. 1A) to torque sub 23 of liner string 13 for transmitting torque to liner string 13 and supporting the weight of liner string 13. Liner running tool 27 has an external profile proximate to internal profile 25 and configured to mate with internal profile 25. A tubing string 28 supports BHA 19 in bottom sub 15 and couples to liner running tool 27 so that BHA 19 is also latched into torque sub 23. Rotating drill pipe 26 by a drilling rig (not shown) rotates liner running tool 27, which in turn rotates torque sub 23 because of its engagement with profile 25. This results in the entire liner string 13 and BHA 19 rotating. Tubing string 28, such as drill pipe, may provide fluid communication between BHA 19 and running tool 27 for transmitting drilling fluid down from the drilling rig to BHA 19. Other devices for rotating liner string 13 are feasible, including having torque sub 23 located near the lower end of liner string 13 rather than at the upper end as shown in FIG. 1B.

Referring now to the exemplary embodiment of FIGS. 1A and 1B, liner string 13 also includes a lower polished bore receptacle 29 located above torque sub 23. Lower polished bore receptacle 29 is a tubular member having a smooth bore for sealing purposes. A liner hanger 31 mounts to the upper end of lower polished bore receptacle 29. Liner hanger 31 will be placed in a set position before removing drill pipe string 26, running tool 27 and BHA 19. Liner hanger 31 may be a type that can be reset in order to retrieve BHA 19 for repair or replacement. If resettable, in the illustrated embodiment of a liner drilling system, the operator may run BHA 19 back into engagement with torque sub 23 and release liner hanger 31 to continue drilling. Alternative liner drilling systems are described below with reference to pending patent application 2009/347,443. Alternately, liner hanger 31 may be a type that is set only once and remains set. Liner hanger 31 has slips 33 that grip the inner diameter of casing string 11 and support the weight of liner string 13 when set. At the completion of drilling, liner hanger 31 will be set near the lower end of casing string 11.

Pending patent application Ser. Nos. 12/347,610 and 12/347,443 illustrate liner drilling systems that may perform the functions of drilling, retrieving, and optionally, rerunning the bottom hole assembly. These patent applications are incorporated entirely by reference. In the alternative liner drilling system illustrated in pending patent application Ser. No. 12/347,443, the liner is drilled in the following manner. The concentric inner and outer strings of tubulars are assembled with a drilling bottom hole assembly located at the lower end of the inner string. The outer string includes a string of liner with a liner hanger at its upper end. The operator lowers the inner and outer strings into the well and rotates the drill bit and an underreamer or a drill shoe on the liner to drill the well. In the resettable system, prior to reaching the selected total depth for the liner, the operator may set the liner hanger, release the liner hanger running tool, and retrieve the inner string. The liner hanger engages previously installed casing to support the liner in tension. The operator repairs or replaces components of the inner string and reruns them back into the outer string. The operator then re-engages the running tool and releases the liner hanger and continues to rotate the drill bit and underreamer or drill shoe to deepen the well.

Preferably the setting and resetting of the liner hanger in pending patent application Ser. No. 12/347,443 is performed by a liner hanger running or control tool mounted to the inner string. The operator may drop a sealing element onto a seat located in the liner hanger control tool. The operator then pumps fluid down the inner string to move a portion of the liner hanger control tool axially relative to the inner string. This movement along with slacking off weight on the inner string results in the liner hanger moving to an engaged position with the casing. The liner hanger is released by re-engaging the liner control tool with the liner hanger, lifting the liner string and applying fluid pressure to stroke the slips of the liner hanger downward to a retracted position. Seals are often located between the inner string and the outer string near the top and bottom of the liner, defining an inner annular chamber. The operator may communicate a portion of the drilling fluid flowing down the inner string to this annular chamber to pressurize the inner chamber. The pressure stretches the inner string to prevent it from buckling. Preferably, the pressure in the annular chamber is maintained even while adding additional sections of tubulars to the inner string. This pressure maintenance may be handled by a check valve located in the inner string. Further details regarding the drilling and operation of the alternative embodiment of a liner drilling system may be found in the incorporated reference of pending patent application 2009/347,443.

Figure 2A:
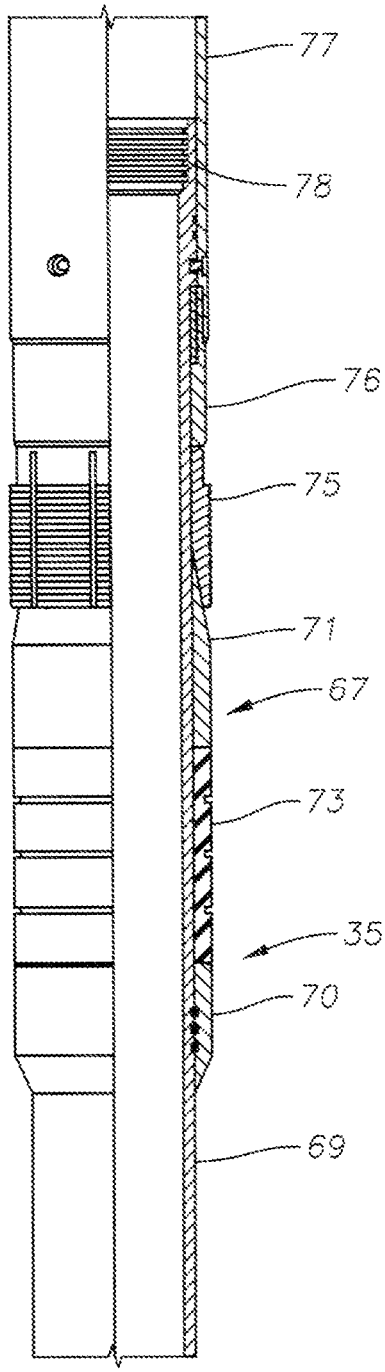
FIGS. 2A, 2B, and 2C are enlarged sectional views of exemplary packer and cementing assembly of the system of FIGS. 1A and 1B employed during a drilling and cementing operation.
Figure 2B:
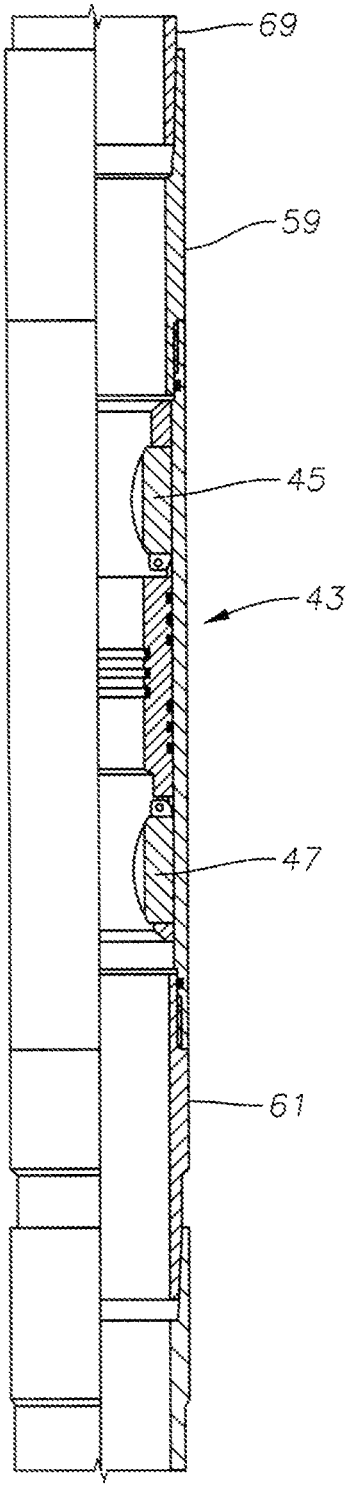
Figure 2C:
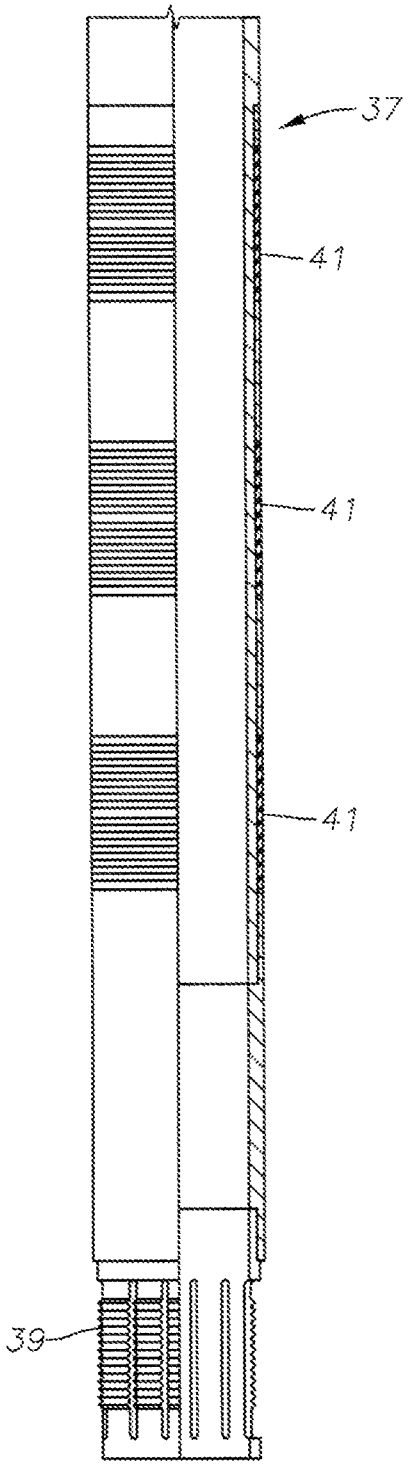
Figure 7A:
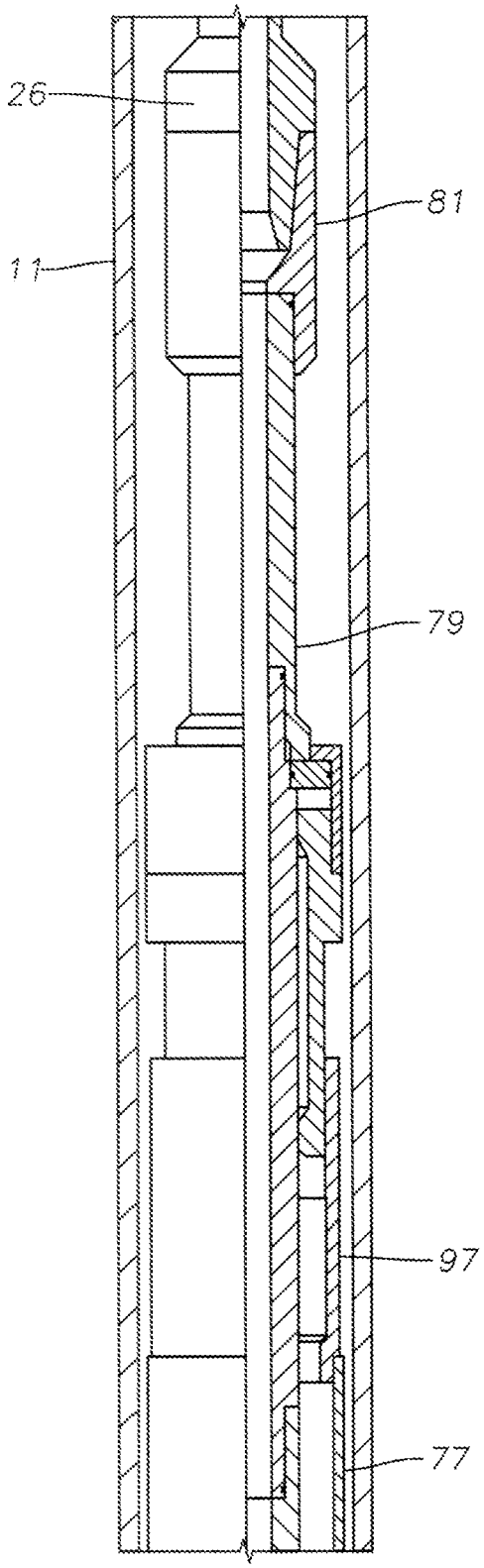
FIGS. 7A-7F are sectional views of the packer and cementing assembly of FIGS. 2A-2B, the liner packer setting tool of FIGS. 5A-5B, and the cement plug of FIG. 6 in use in the concentric strings of FIGS. 1A-1B.
Figure 7B:
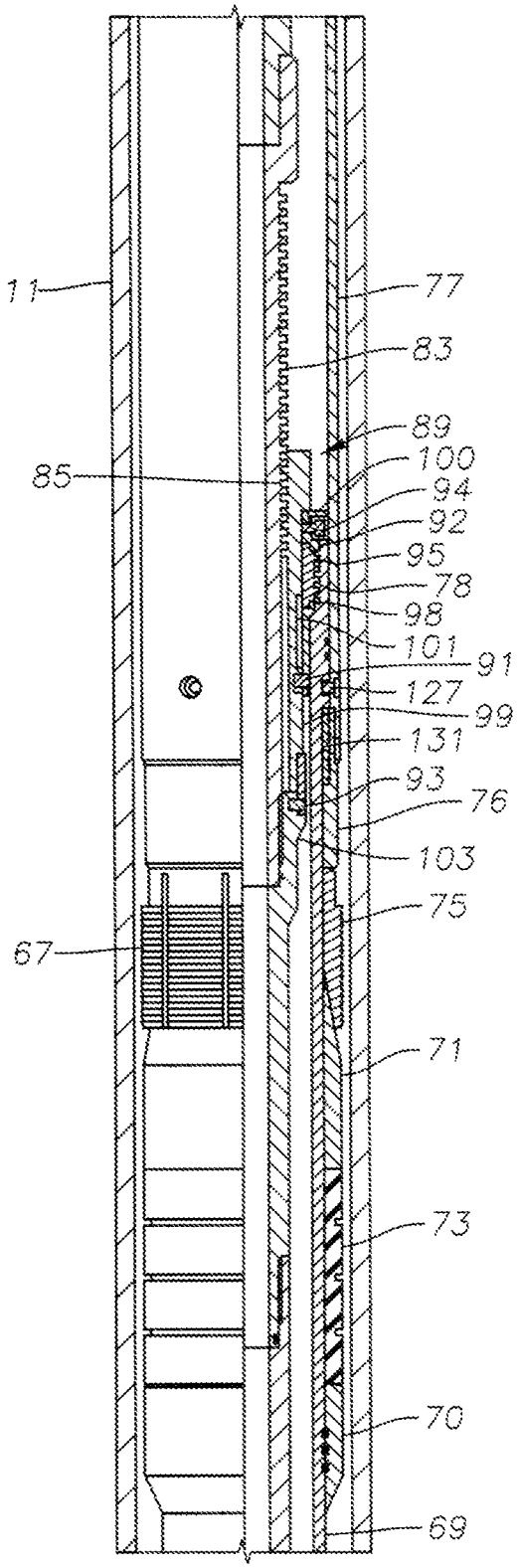

Once the well has been drilled to total depth and BHA 19 and adapter tool 27 are retrieved, liner string 13 will be in condition for cementing. Referring to FIGS. 2A, 2B, and 2C there is shown a packer and cementing assembly 35 being lowered into engagement with liner hanger 31, upper polished bore receptacle 29 and the upper portion of torque sub 23 of FIGS. 1A-1C. FIGS. 2A, 2B, and 2C illustrate an example configuration of packer and cementing assembly 35 as it would appear prior to lowering into casing 11. Packer and cementing assembly 35 includes on its lower end a tie back seal nipple 37, as shown in FIG. 2C. Tie back seal nipple 37 as shown is a tubular member having seals 41 located on its outer diameter. Seals 41 are adapted to sealingly engage the inner diameter of lower polished bore receptacle 29 (FIGS. 1A and 1B). Tie back seal nipple 37 has an optional latch 39 on its lower end with gripping members that will engage grooved profile 25 in the upper end of torque sub 23, as shown in FIG. 7F.

Figure 3A:
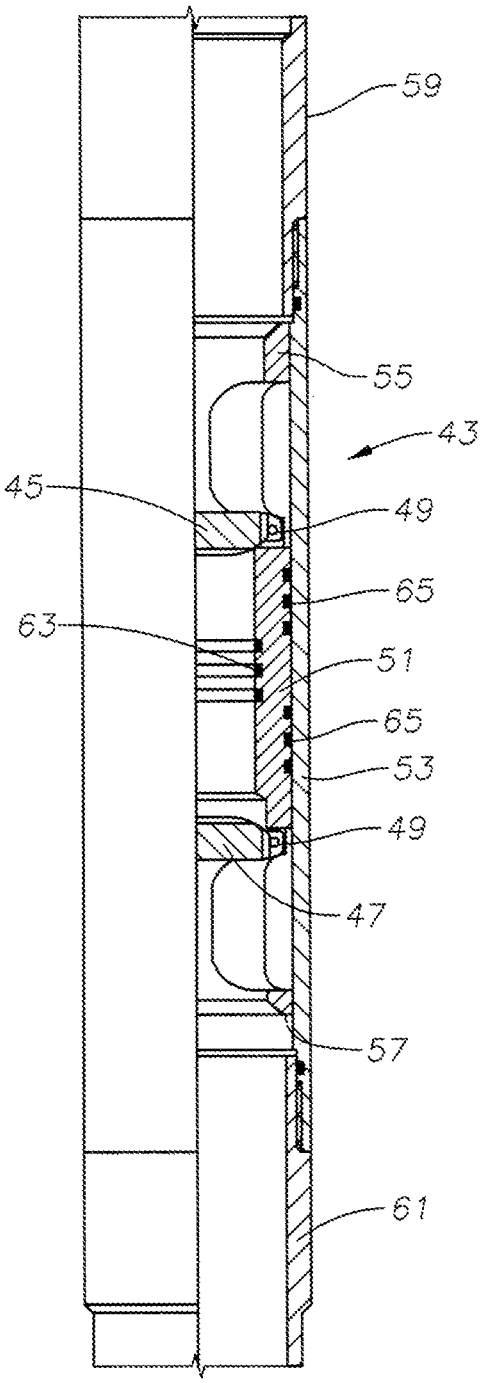
FIG. 3A is an enlarged sectional view of a closed check valve of the assembly of FIGS. 2A and 2B following setting of a liner top packer of the assembly of FIGS. 2A-2B.
Figure 3B:
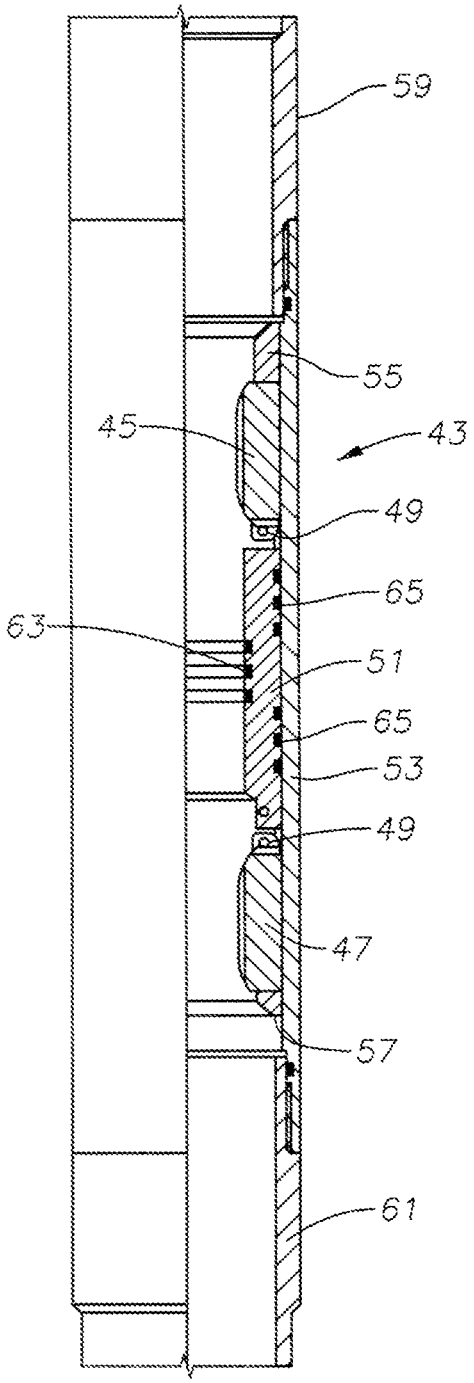
FIG. 3B is an enlarged sectional view of an open check valve of the assembly of FIGS. 2A and 2B.

Referring to FIG. 2B, a two-way check valve assembly 43 connects to the upper end of tie back seal nipple 37. As shown in FIGS. 3A and 3B, two-way check valve assembly 43 comprises a mechanism that has an open position and a closed position. In the closed position, shown in FIG. 3A, check valve assembly 43 seals against pressure from above and against pressure from below. In the open position, shown in FIG. 3B, check valve assembly 43 allows fluid to flow through in both directions. In this example, check valve assembly 43 comprises an upper flapper 45 and a lower flapper 47, each of which may pivot between an open position shown in FIG. 3B and a closed position, shown in FIG. 3A. Flappers 45, 47 are of a size and shape such that when in the closed position, flappers 45, 47 will substantially close a bore defined by the internal diameter of a tubular central body 51. Both flappers 45 and 47 are connected by hinges 49 to tubular central body 51. The hinge 49 for upper flapper 45 connects upper flapper 45 to an upward facing seat of central body 51. The hinge 49 for lower flapper 47 connects it to a downward facing seat of body 51. Hinge 49 pivotally connects flapper 45, 47 to body 51 through a pin passing through a bore in an end of each flapper 45, 47 and a bore in the upper and lower hinges 49. The bores in the ends of flappers 45, 47, and the bores in the upper and lower hinges 49 are perpendicular to an axis passing through a center of body 51. When in the closed position, as shown in FIG. 3A, upper flapper 45 will seal against the upward facing seat and lower flapper 47 will seal against the downward facing seat. Upper and lower flappers 45 and 47 may be biased by a resistant member, such as springs (not shown), to the closed position. The positions of flappers 45, 47 may be reversed; flapper 47 may be biased to seal pressure from above and flapper 45 from below.

Figure 3C:
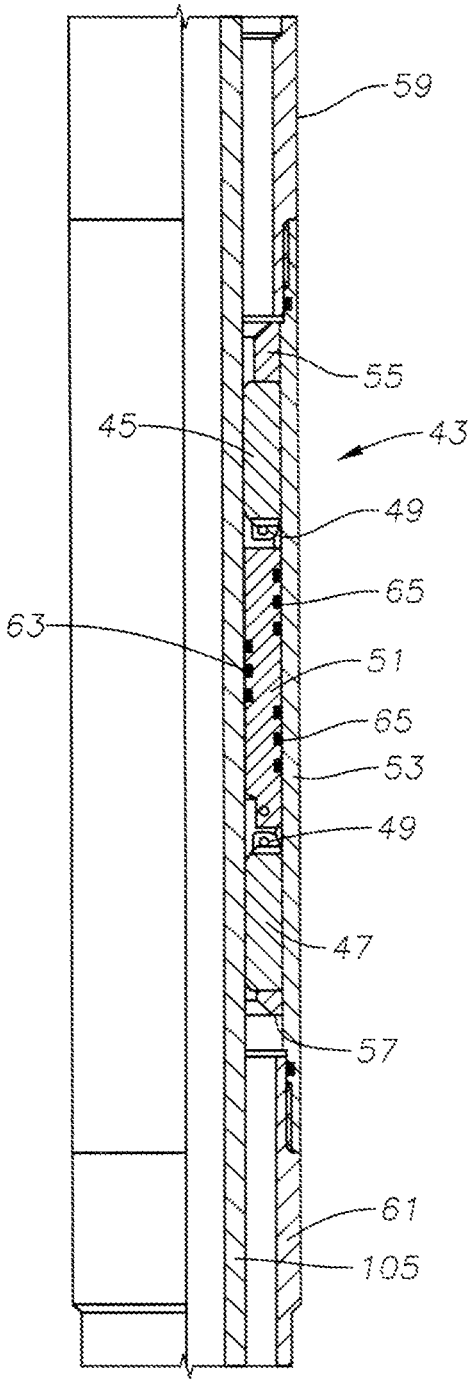
FIG. 3C is an enlarged sectional view of an open check valve during an example of setting of the liner top packer of the assembly of FIGS. 2A-2B.

Central body 51 is shown as an annular member concentrically located within a tubular housing 53. Central body 51 has an upper portion 55 that extends upward from central body portion 51 and a lower portion 57 that extends downward away from the upper portion 55. Body upper portion 55 is restricted from moving upward by contact with a top adapter 59 secured to the upper end of housing 53. Lower portion 57 is restricted from moving downward by engagement with a bottom adapter 61. Central body 51 has inner seals 63 on its inner diameter and outer seals 65 that seal to the inner diameter of housing 53. Flappers 45 and 47 can be held in the open position by a central tubular member, such as stinger 105 as shown in FIG. 3C and described in more detail below, or optionally lower release body 103, not shown in FIG. 3C. Two-way check valve 43 may be formed of a drillable material, such as aluminum. Rather than flappers, optionally upper and lower ball check valves may make up valves 45, 47.

Figure 4A:
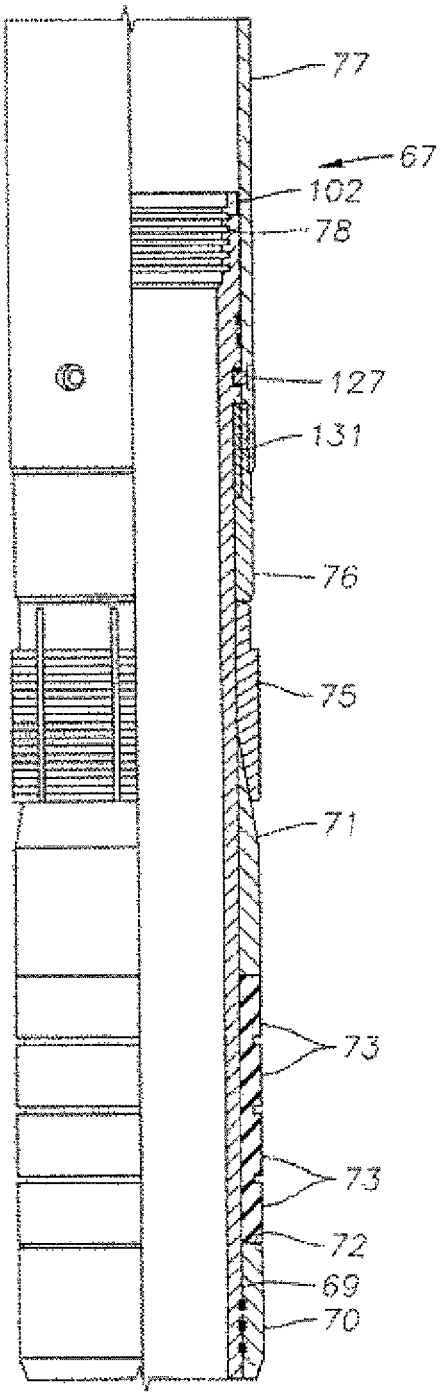
FIG. 4A is an enlarged sectional view of the liner top packer of the assembly of FIGS. 2A-2B.

Referring again to FIGS. 2A and 2B, a liner top packer 67 secures to the upper end of top adapter 59. Liner top packer 67 may be a conventional packer for sealing between liner string 13 and the inner diameter of casing 11 (FIG. 1A). In this example, liner top packer 67 is set by rotation although it could be set by weight or hydraulically set. As shown in FIG. 4A, liner top packer 67 has a body 69 that is tubular. An annular seat 70 secures to an exterior lower end of body 69 by any suitable means, such as by threads or an interference fit. Seat 70 defines an upward facing shoulder 72 that is configured to exert a reactive force in an axial direction. Elastomeric packer elements 73 are located around body 69 axially above upward facing shoulder 72. A conical ramp sleeve 71 is positioned around body 69 above and adjacent to packer elements 73. The outer diameter of conical ramp sleeve 71 may slope radially inward from a transition with distance from the packer elements 73. A set of slips 75 is positioned on the upper end of conical ramp sleeve 71 adjacent to reduced radius portion. An interior upper end of body 69 has a set of left-hand threads 78. Body 69 defines a plurality of slots 102 formed in an upper end of body 69 proximate to threads 78. Slots 102 extend from an upper edge of body 69 axially downward to define an upward facing shoulder. A setting sleeve 76 surrounds a portion of body 69 and engages the upper end of slips 75. A ratchet element 131 is interposed between an upper end of the setting sleeve 76 and body 69. Ratchet element 131 includes collet like shaped teeth on the inner and outer diameter surfaces of ratchet element 131. The outer diameter teeth on ratchet element 131 engage corresponding teeth on setting sleeve 76, and the inner diameter teeth on ratchet element 131 engage corresponding teeth on the outer diameter surface of tubular body 69. Packer 67 is shown in the unset position in FIG. 4A. When set, as described below, slips 75 may engage the inner diameter of casing 11 (FIG. 1A) to hold liner top packer 67 in the set position. In addition, packer elements 73 can expand radially, sealing the annulus between liner top packer 67 and casing 11.

A tie back sleeve 77 may be mounted to the upper end of body 69 with shear screws 127. A lower end of tie back sleeve 77 couples to a setting sleeve 76, such as through a threaded connection between the lower end of tie back sleeve 77 and the upper end of setting sleeve 76. When set, shear screws 127 will shear under a predetermined axial load, transferring downward force applied to tie back sleeve 77 to setting sleeve 76. Tie back sleeve 77 may optionally be an upper polished bore receptacle. If another packer is required for sealing to casing string 11 such as if there is a problem with liner top packer 67, tie back sleeve 77 may be utilized for sealing purposes in a manner similar to polished bore receptacle 29. Prior to cementing, packer and cementing assembly 35 of FIGS. 2A and 2B can be lowered into engagement with torque sub 23, lower polished bore receptacle 29 and liner hanger 31 shown in FIGS. 1A and 1B. Packer and cementing assembly 35 may remain in the wellbore after cementing.

Figure 4B:
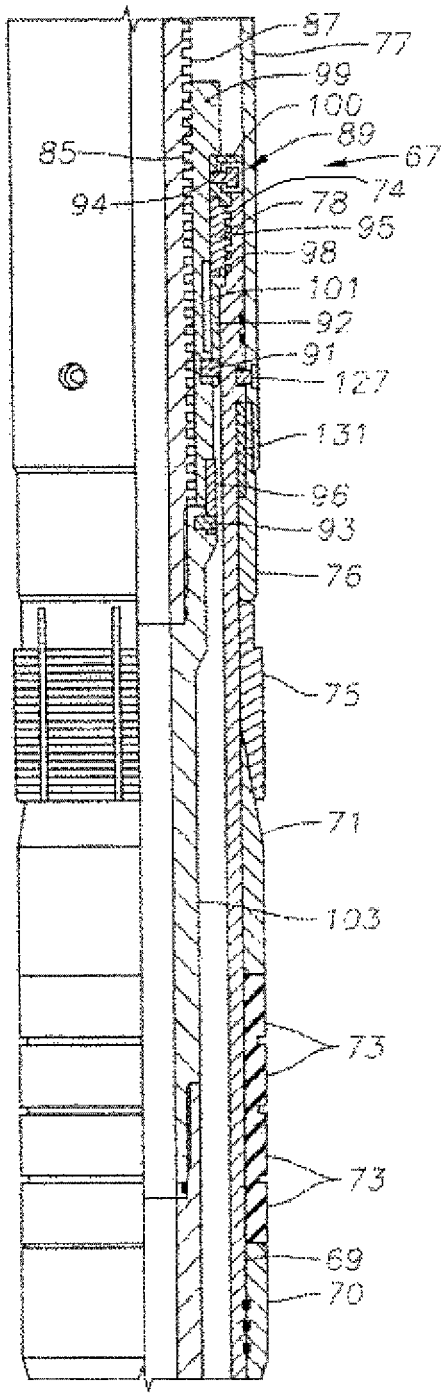
FIG. 4B is an enlarged sectional view of the liner top packer of the assembly of FIGS. 2A-2B.
Figure 4C:
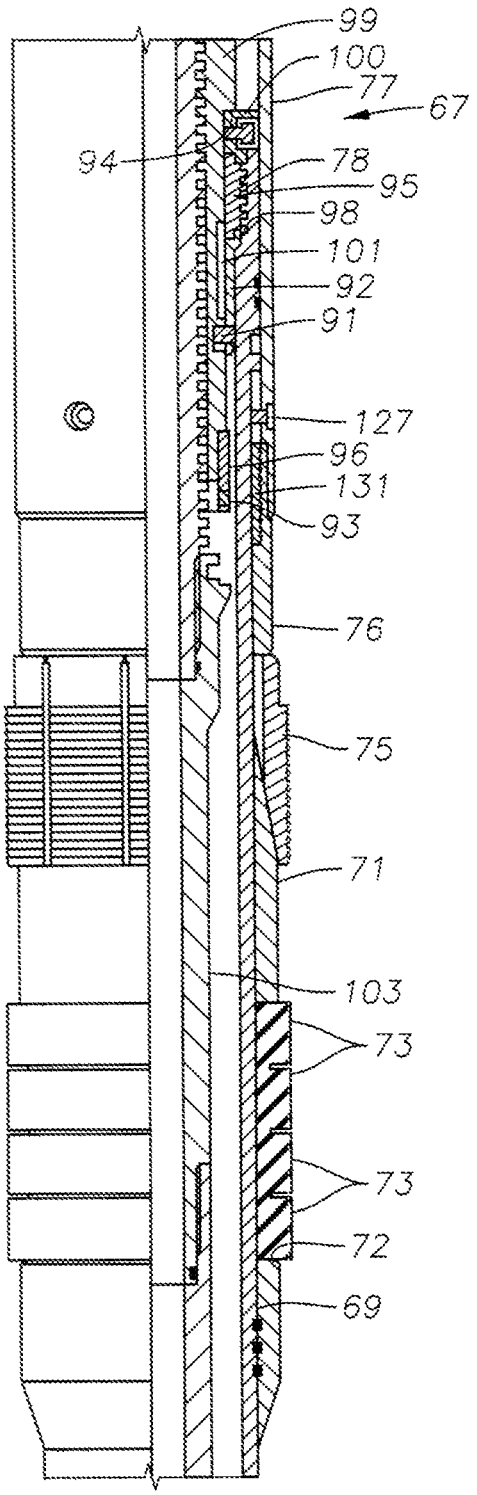
FIG. 4C is an enlarged sectional view of the liner top packer of the assembly of FIGS. 2A-2B shown in a set configuration.
Figure 4D:
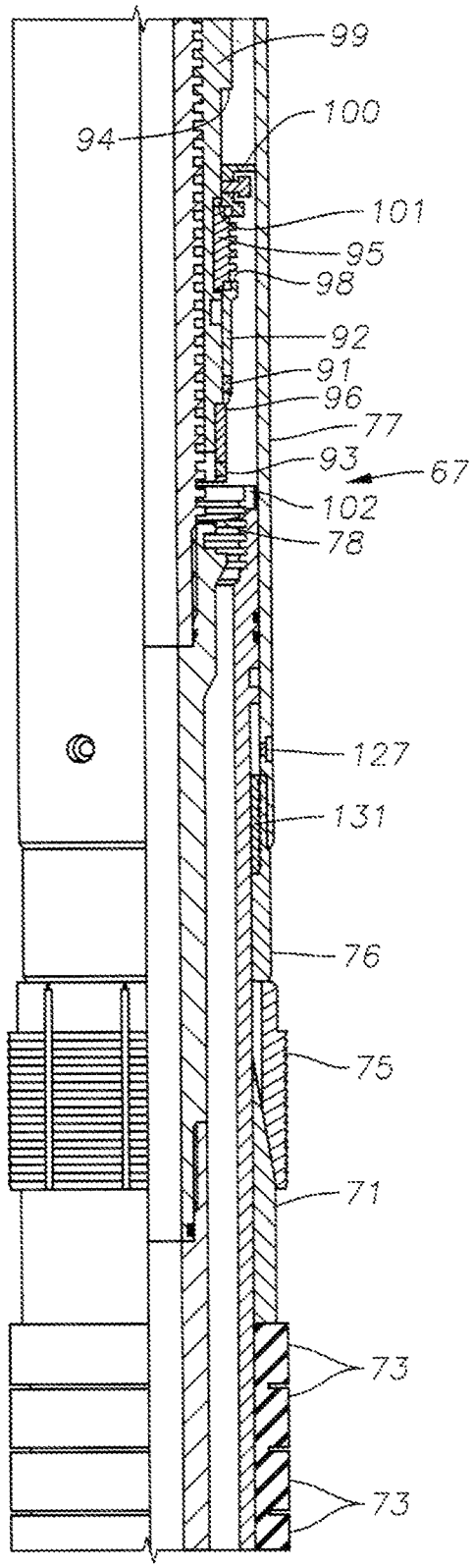
FIG. 4D is an enlarged sectional view of a packer setting tool released from a set liner top packer of the assembly of FIGS. 2A-2B.
Figure 5A:
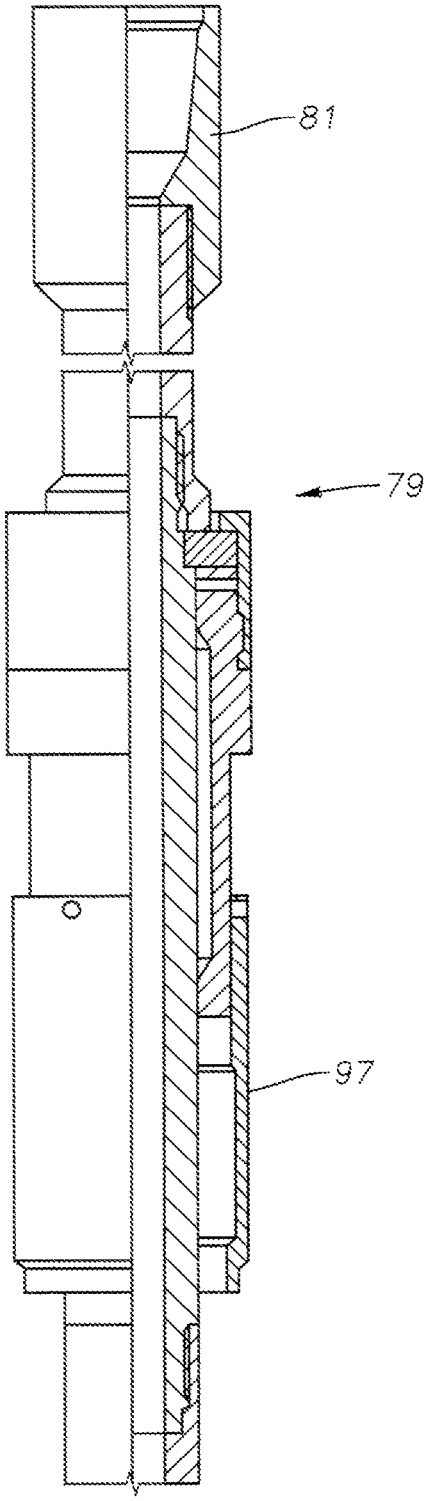
FIGS. 5A and 5B are enlarged sectional views of an exemplary liner packer setting tool.
Figure 5B:
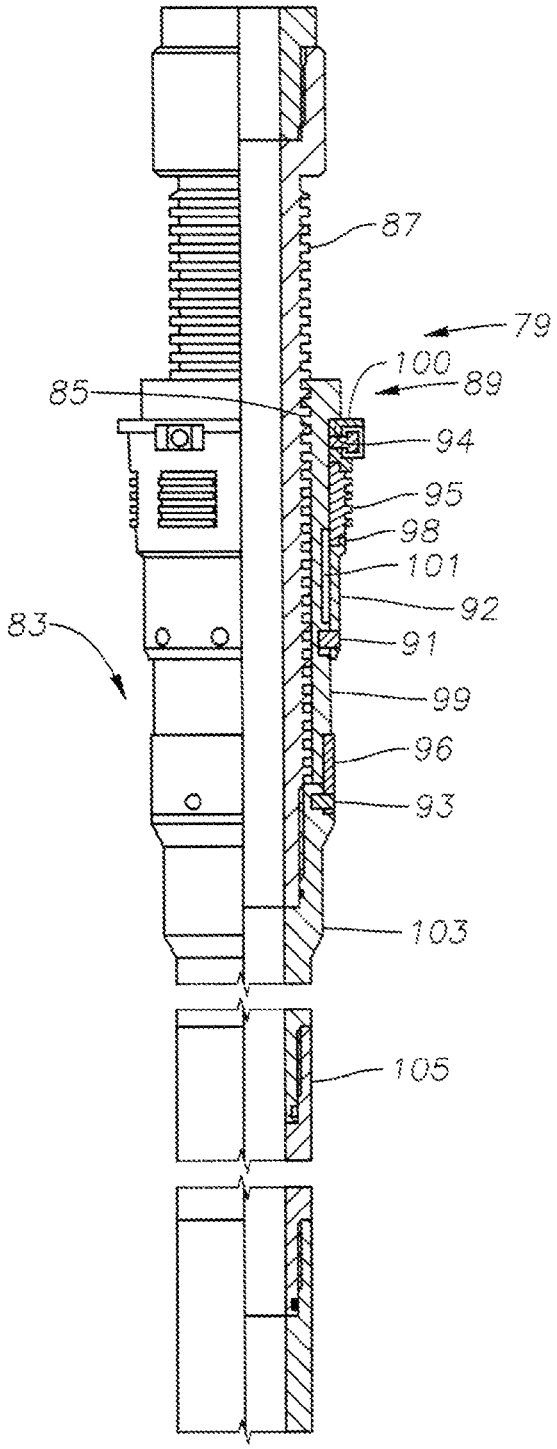

FIGS. 5A and 5B illustrate in partial side section view an exemplary embodiment of a running tool assembly 79 prior to assembly with packer and cementing assembly 35. Running tool assembly 79 includes an adapter 81 at the upper end for securing it to a work string such as a string of drill pipe. Running tool assembly 79 includes a packer setting tool 83 (FIG. 5B) and an adapter sleeve 97, which secure to the lower end of adapter 81. Packer setting tool 83 is a type utilized for setting packer 67 (FIGS. 2A, 4A-4D). In this example, packer setting tool 83 is a mechanical type tool that may be set in response to rotation and weight imposed by the work string.

As shown in FIG. 5B, packer setting tool 83 has a coarse multi-start thread 85 for selectively connecting a tubular release body 87 coaxially within an annular engaging sub, such as a dog sub 89. Dog sub 89 comprises upper shear screws 91, dog retainer ring 92, lower shear screws 93, dog 95, coupler ring 96, actuation ring 99, and lower release body 103. Dog retainer ring 92 circumscribes actuation ring 99 at downward facing shoulder 94. Downward facing shoulder 94 limits upward axial movement of dog retainer ring 92. Dog retainer ring 92 defines dog window 98 through which dog 95 protrudes while securing dog 95 to dog sub 89. Upper shear screws 91 rotationally lock dog retainer ring 92 to actuation body 99 and prevent radial movement of dog 95 during running and setting of liner top packer 67. Drive dogs 100 secure to dog retainer ring 92 with a cap screw and rotationally locks dog retainer ring 92 to body 69 of liner top packer 67 (FIGS. 4B and 4C) by inserting into slots 102 (FIG. 4A) formed in an upper end of body 69 proximate to coarse thread 78. Lower shear screws 93 secure coupler ring 96 to lower release body 103. Coupler ring 96 may couple to actuation ring 99 with set screws or some other suitable mechanism. Upper and lower shear screws 91, 93 maintain the position of packer setting tool 83 relative to liner top packer 67, as shown in FIG. 4B, as running tool assembly 79 is run into the inner and outer concentric strings of FIGS. 1A, 1B, and 1C. Actuation ring 99 couples to release body 87 by coarse threads 85 on an upper inner diameter surface of actuation ring 99. In the exemplary embodiment, coarse threads 85 are right hand threads. Actuation body 99 defines an annular recess 101 on an exterior surface of actuation body 99 proximate to dog 95.

As shown in FIG. 4B, when engaged in liner top packer 67, dog sub 89 will be secured to left-hand threads 78 of inner tubular body 69 of liner top packer 67 through dogs 95. In an exemplary embodiment, dogs 95 have a plurality of ribs 74 on an exterior diameter surface of dogs 95 configured to engage left-hand threads 78. The engagement of dog sub 89 with threads 78 connects packer and cementing assembly 35 of FIGS. 2A-2C to running tool assembly 79 of FIGS. 5A and 5B. When engaged, a lower shoulder of adapter sleeve 97 abuts an upper shoulder of tie back sleeve 77, as shown in FIG. 7A. As shown in FIG. 7B, drive dog 100 will rotationally lock dog retainer ring 92 to body 69 of liner top packer 67, by passing into slot 102 after assembly of liner top packer 67 to running tool assembly 79. Slot 102 extends from an upper end of body 69 axially downward and has a width substantially equivalent to a width of drive dog 100 of FIG. 5B.

Referring to FIG. 3C a stinger 105 depends downward from lower release body 103, which is a tubular member that extends through two-way check valve 43 and holds flappers 45 and 47 in the open position. Seals 63 seal against stinger 105. Stinger 105 has an annular cementing plug 107 releasably connected to its lower end as shown in FIG. 7D. In the illustrated embodiment, cementing plug 107 is a latching type. A person skilled in the art will understand that a non-latching type plug may be used.

Figure 6:
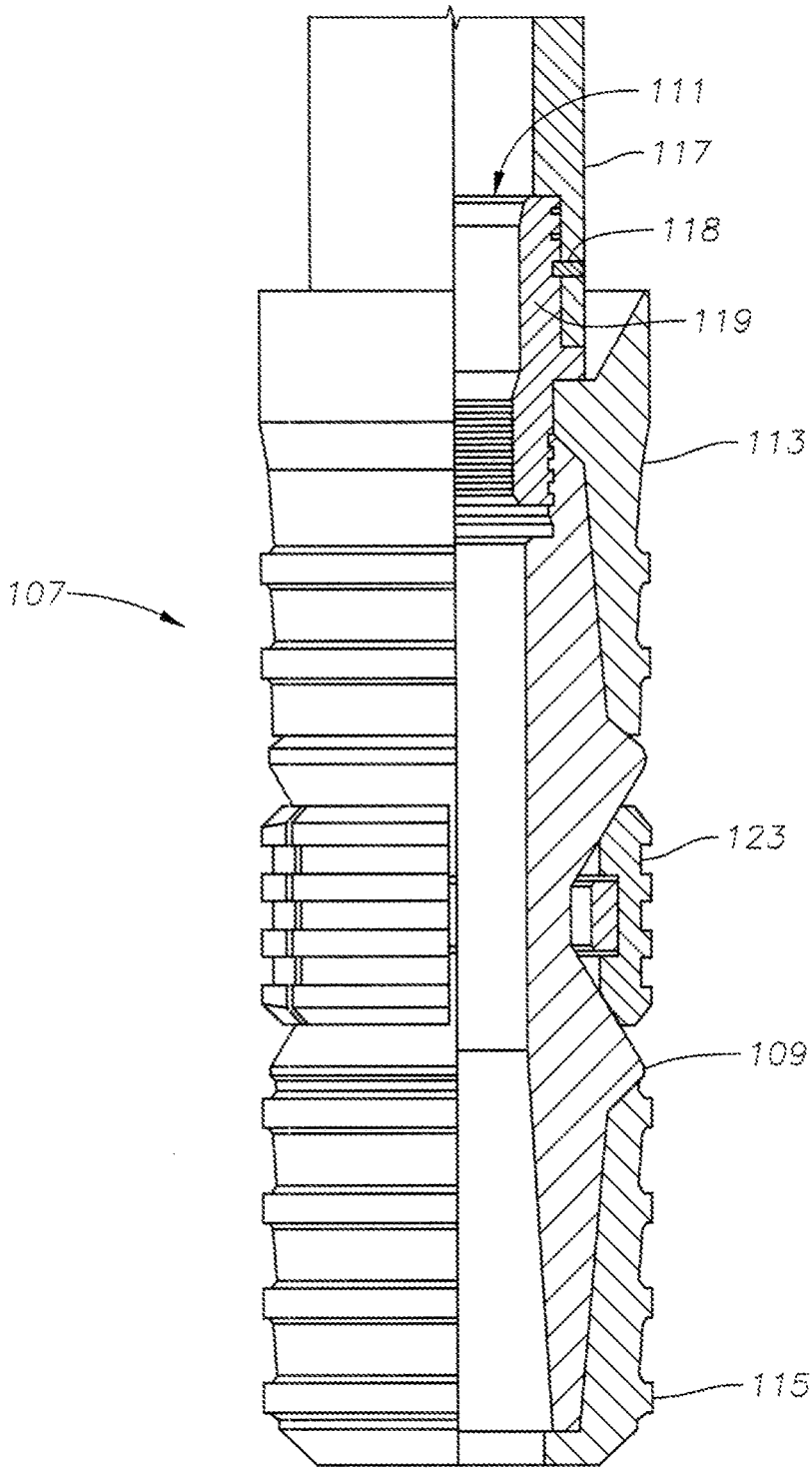
FIG. 6 is an enlarged view of an exemplary liner drilling cement plug.

As shown in FIG. 6, cementing plug 107 has a tubular inner body 109 that may be rigid and formed of a drillable material. An axial passage 111 extends through inner body 109 for the passage of fluid. Outer sleeve 113 circumscribes upper and lower ends of the inner body 109, where outer sleeve 113 may be formed of elastomeric material and has circumferentially extending ribs 115. Ribs 115 are adapted to form a seal in BHA sub 15 (FIG. 1B). Referring now to FIG. 7D, an adapter 117 secures latching plug 107 to the lower end of stinger 105. An internal seat 119 attaches to body 109 of plug 107. Seat 119 attaches to adapter 117 with shear screws 118. Seat 119 is adapted to receive a sealing object pumped down, such as a dart 121. Dart 121 may be a conventional pump-down member that has seals. Once in sealing engagement with seat 119, the combination of dart 121, latching plug 107, and seat 119 may form a seal in liner string 13. In this embodiment, a latch 123 extends around body 109 and between the outer sleeve 113 for engaging profile 17 (FIG. 1C).

In an exemplary operation, the well is drilled utilizing liner string 13 as a drill string. Once at a designated depth, such as total depth, liner hanger 31 (FIG. 1A) is set in casing string 11 to support the weight of liner string 13. An operator can retrieve liner running tool 27, tubing string 28 and bottom hole assembly 19 (FIG. 1C).

Personnel can assemble running tool assembly 79 of FIGS. 5A and 5B in packer and cementing assembly 35 of FIGS. 2A-2C. Assembly may take place in a shop or in the field. When doing so, the operator may secure dog 95 of dog sub 89 to threads 78 by left-hand rotation. Dog sub 89 will then be rotationally locked to body 69 of liner top packer 67 by insertion of drive dogs 100 into slots 102. Stinger 105 can pass through two-way check valve 43, retaining flappers 45, 47 in the open position. Seals 63 (FIG. 3C) seal around stinger 105. Tie back seal nipple 37 may be spaced such that when lowered into casing string 11, it will be substantially located within lower polished bore receptacle 29. Latching plug 107 may be in sealing engagement with tie back seal nipple 37. Dart 121 will not be in the position shown in FIG. 7D at this time; instead, dart 121 may be dropped down the drill string supporting running tool assembly 79 from the surface at a designated time. As mentioned above, dog sub 89 can be secured to left-hand threads 78 (FIG. 4B) of inner tubular body 69 of liner top packer 67 through dogs 95. The entire assembly comprising FIGS. 2A, 2B, 2C and FIGS. 5A, 5B can be delivered to the drilling rig. An operator can secure adapter 81 to a work string, such as drill pipe 26 (FIG. 7A), and lower the entire assembly into position within the inner and outer concentric strings as shown in FIGS. 7A-7F.

Referring to FIG. 7F, latch 39 on the lower end of tie back seal nipple 37 can enter lower polished bore receptacle 29 and latch into the grooved profile formed in the upper end of torque sub 23. Positioning the latching plug 107 (FIG. 7C) within liner hanger 31; two-way check valve 43 is above liner hanger 31 (FIG. 7B). Liner top packer 67 is located within casing string 11, above liner hanger 31, as shown in FIGS. 7B, 7D, and 7E.

Figure 7C:
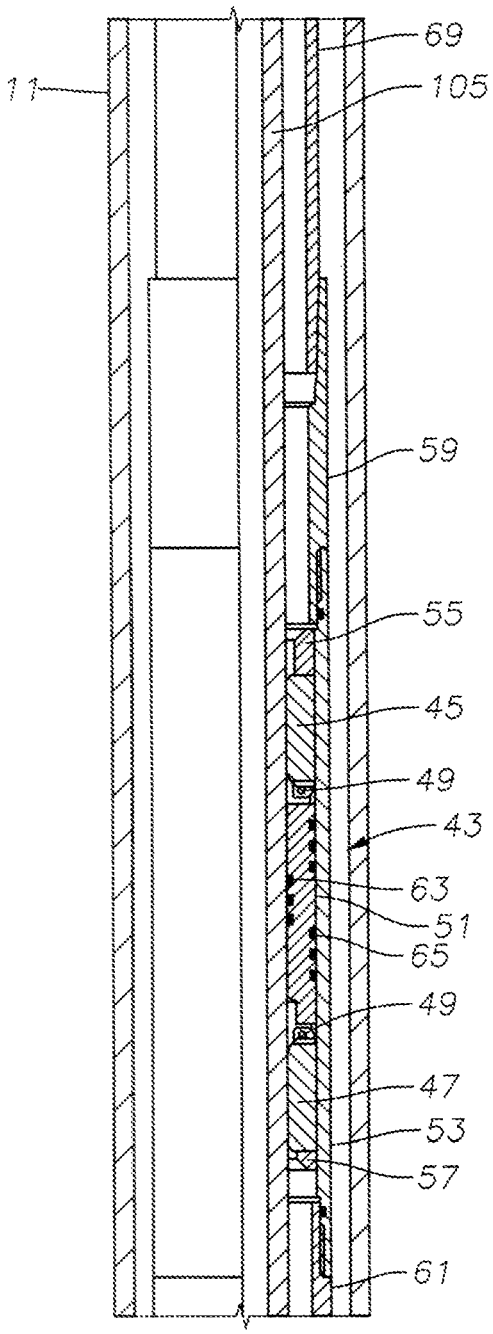
Figure 7D:
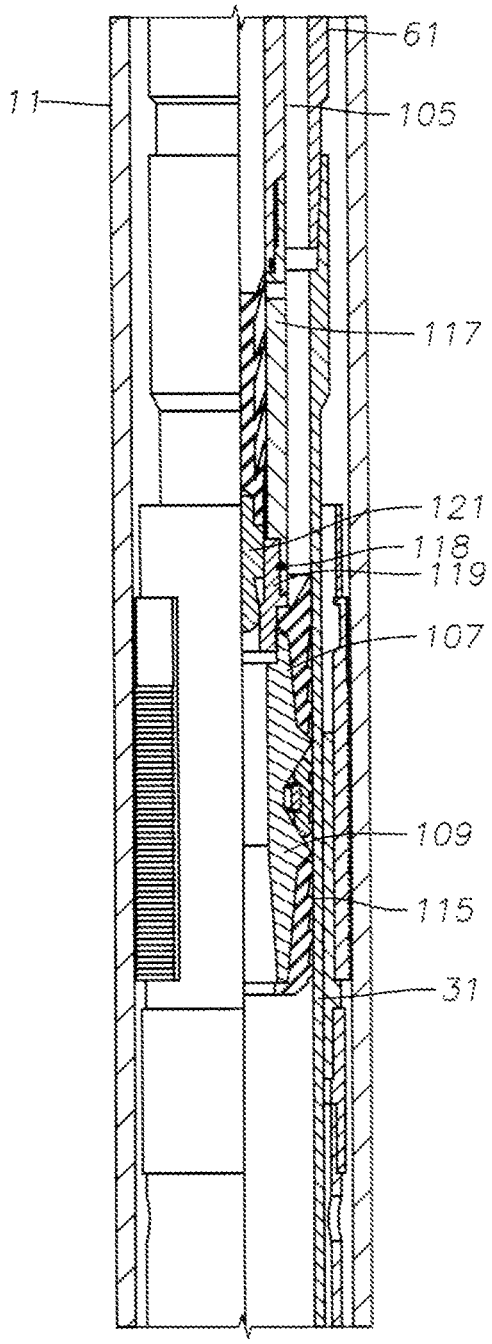
Figure 7E:
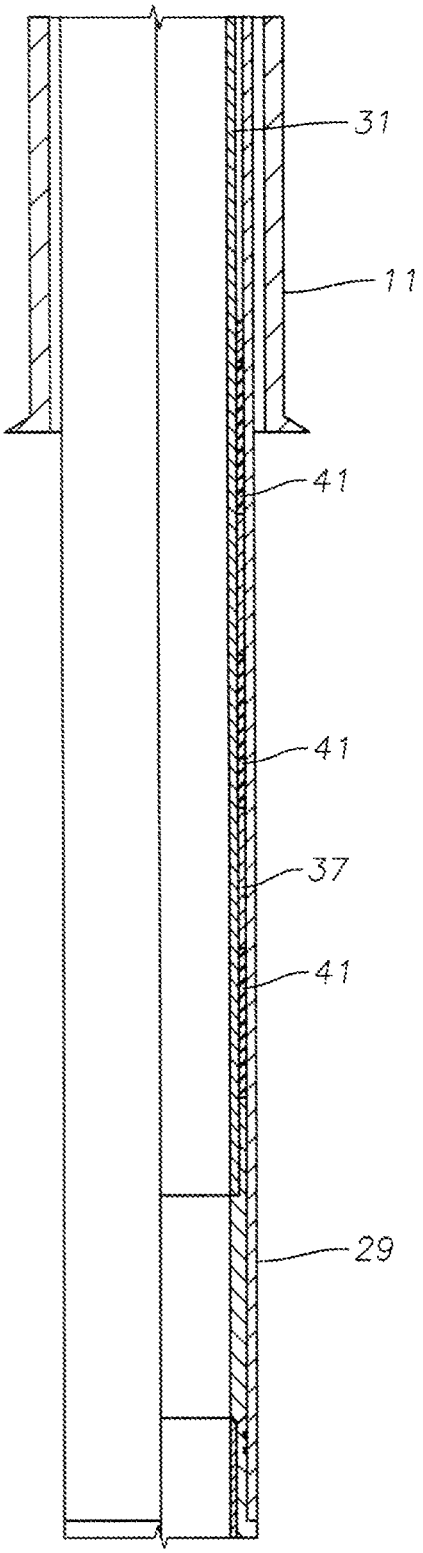
Figure 7F:
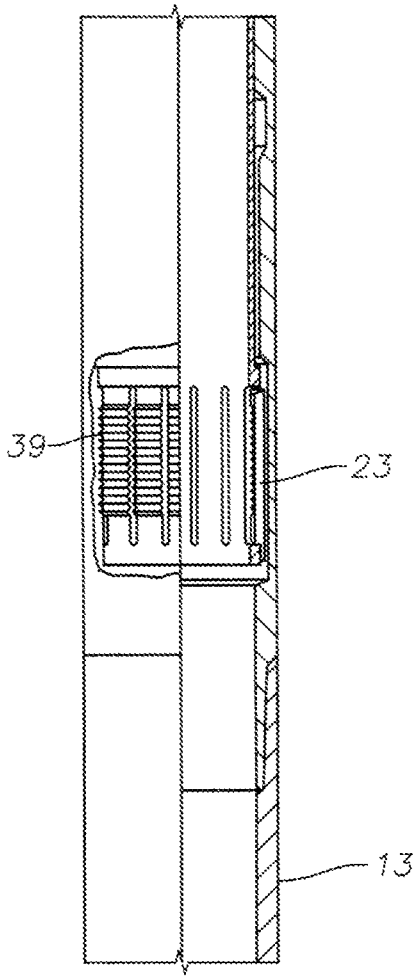
Figure 8A:
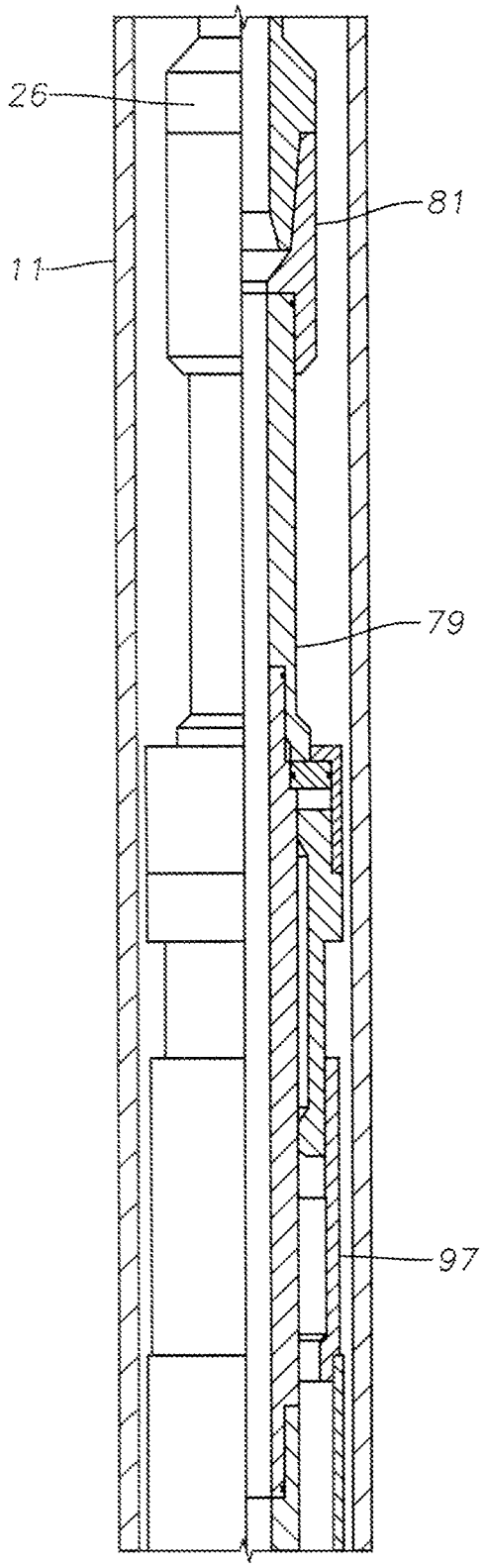
FIGS. 8A-8G are sectional views of the packer and cementing assembly of FIGS. 2A-2B, the liner packer setting tool of FIGS. 5A-5B, and the cement plug of FIG. 6 in the set position in the concentric strings of FIGS. 1A-1B.
Figure 8B:
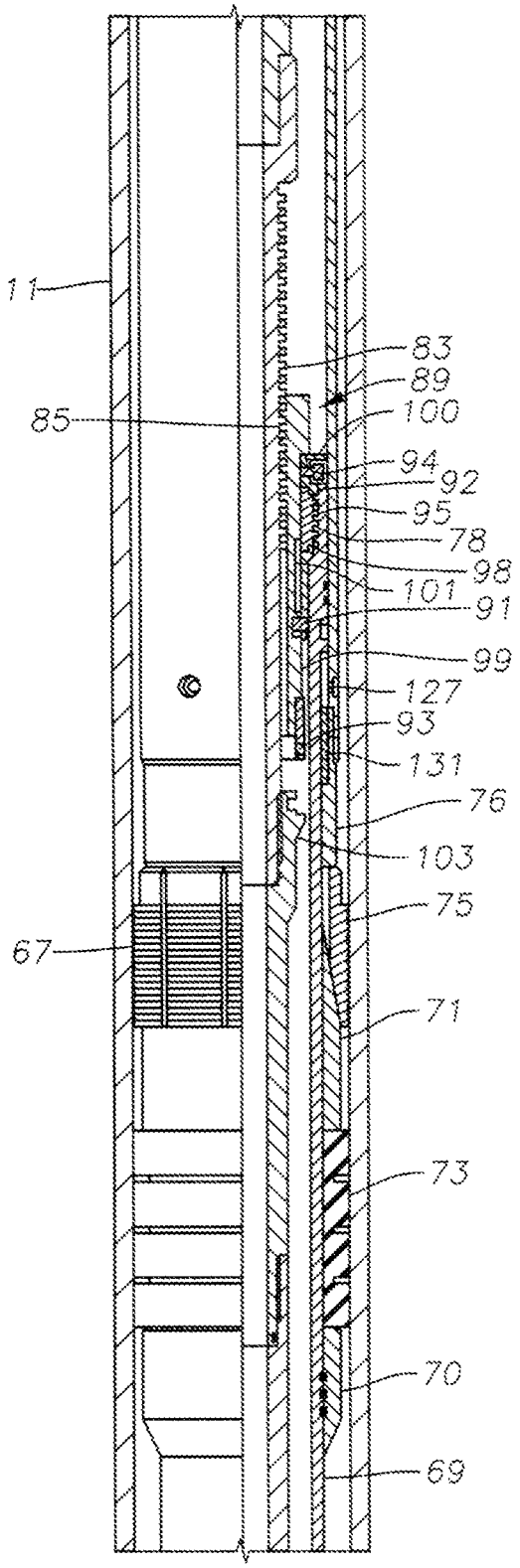
Figure 8C:
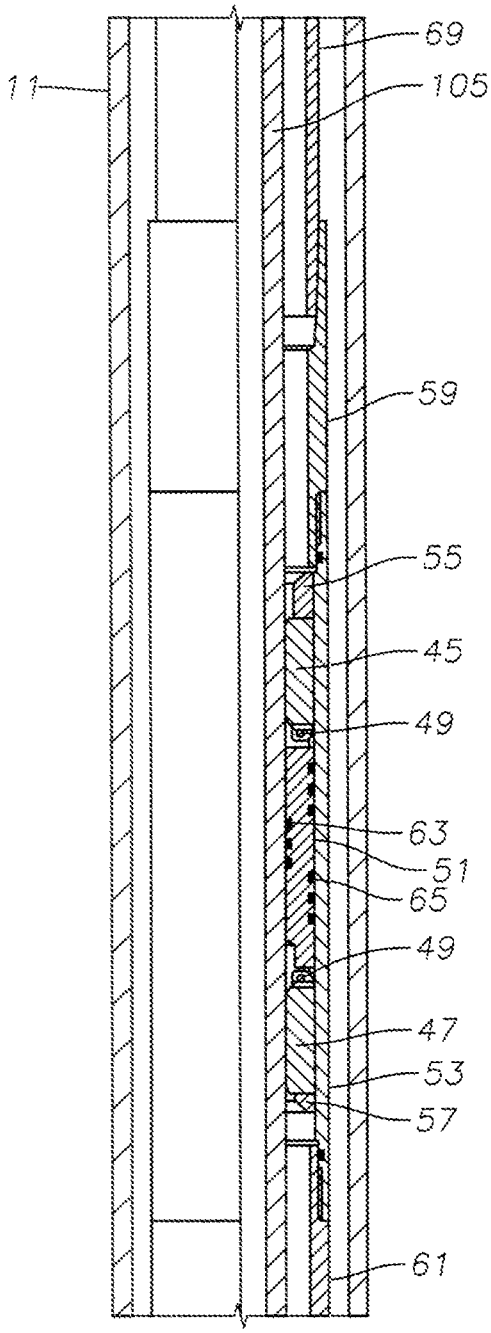
Figure 8D:
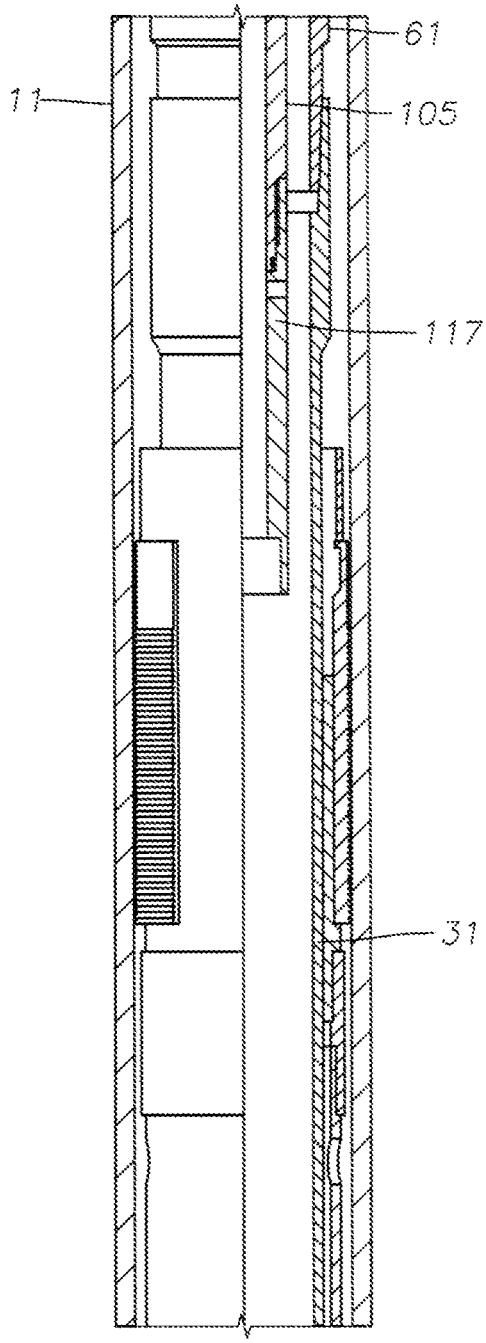
Figure 8E:
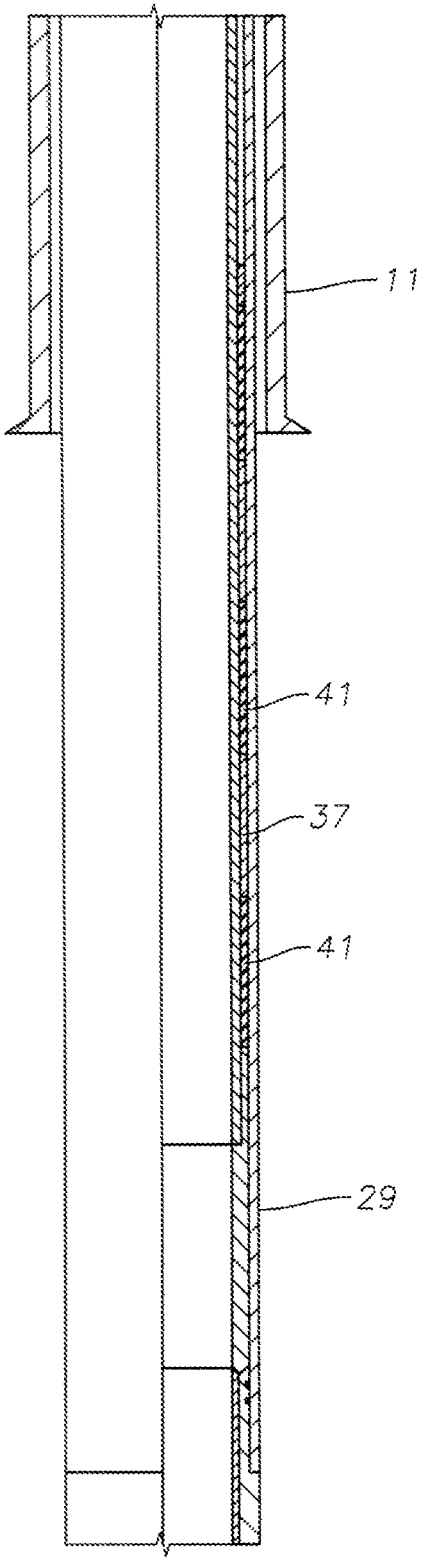
Figure 8F:
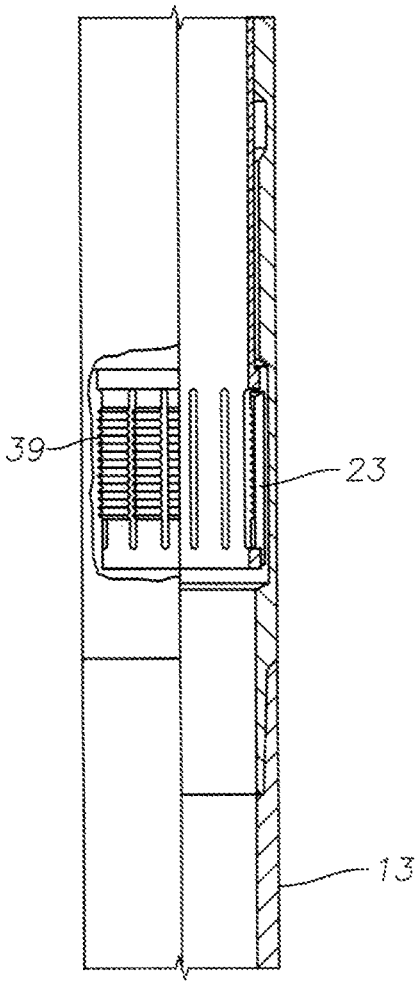
Figure 8G:
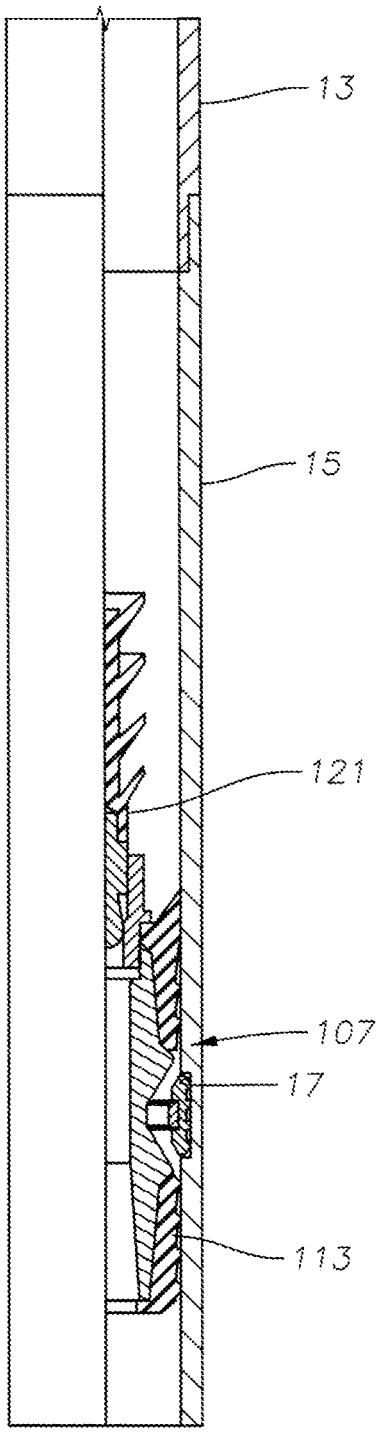

Cement can now be pumped down drill pipe 26 and the assembly as shown in FIGS. 7A-7C. The cement can flow through latching plug 107 (FIG. 7D, the torque sub 23 (FIG. 7F) and out the bottom of liner string 13. When a designated quantity of cement has been dispensed, an operator can drop dart 121 (FIG. 7D) down drill pipe 26 where it can land in sealing engagement with internal seat 119 of latching plug 107. Applying fluid pressure at the surface can shear pin 118 coupling internal seat 119 to adapter 117. Latching plug 107 and dart 121 can then move down in unison from the end of running tool assembly 79 (FIG. 8D) into engagement with profile 17 (FIG. 8G). Once in engagement, latching plug 107 and dart 121 form a seal in bottom sub 15 and are prevented from moving upward by the latching engagement. Latching plug 107 and dart 121 prevent cement in the annulus surrounding liner string 13 from flowing back up within liner string 13. Alternatively, a non-latching type plug may be used.

Liner top packer 67 (FIG. 7B) can be set by first pulling running tool assembly 79 up to slack off the downward force on drill pipe 26 and any attached assemblies without completely removing all downward force on drill pipe 26. In an exemplary embodiment, the downward force is about 50,000 lbs below drill string weight. The operator can then rotate drill pipe 26 clockwise while maintaining some downward force on running tool assembly 79. As running tool assembly 79 rotates, the weight of the sub assemblies coupled to running tool assembly 79 (FIGS. 7A-7F) and the cementing process prevents liner 13, tie back seal nipple 37, double flapper valve 43, and liner top packer 67 from rotating with running tool assembly 79. This causes dog sub 89 to remain stationary while release body 87 rotates through coarse thread 85, shearing lower shear screws 93 in the process, as shown in FIG. 4C. Continued rotation and maintenance of downward force causes adapter sleeve 97 (FIG. 5A and FIG. 7A) to push down on tie back sleeve 77 (FIGS. 4C, 7A, 7B). Dog sub 89 remains in its axial position as running tool assembly 79 and tie back sleeve 77 move down relative to the liner top packer 67.

As shown in FIG. 4C, downward movement of tie back sleeve 77 shears shear screws 127 or liner top packer 67 and forces setting sleeve 76 down onto slip 75. In response, slip 75 slides axially over an exterior surface of the upper end of ramp sleeve 71. As slip 75 slides down and engages the upper end of ramp sleeve 71, ramp sleeve 71 in turn presses down on packer elements 73, compressing packer elements 73 against upward facing shoulder 72. The compression of packer elements 73 causes packer elements 73 to expand radially into engagement with casing 11. Similarly, slips 75 slide over ramp sleeve 71 and also radially expand into engagement with casing 11 as shown in FIG. 8B. Once engaged, packer elements 73 and slips 75 maintain engagement with casing 11 through ratchet element 131. As setting sleeve 76 moves downward it engages ratchet element 131 and moves the inner diameter teeth of ratchet element 131 past the corresponding teeth of tubular body 69. The inner diameter teeth of ratchet element 131 and the teeth on the outer diameter surface of tubular body 69 are configured to allow linear movement in the downhole direction only. In this manner, ratchet element 131 maintains the downward force of setting sleeve 76 on slips 75 and thereby packer elements 73, keeping slips 75 and packer elements 73 radially expanded and engaged with casing 11.

In the event that displacement plug 107 does not latch in the position shown in FIG. 8G, liner packer 67 may be set as described above. However, it will be necessary to maintain the fluid pressure through drill string 26 while performing the setting operations. If displacement plug 107 fails to latch it will float within the central passageway of bottom sub 15. Fluid pressure may be maintained in a central passageway of running tool assembly 79 during setting of liner top packer 67 by packer setting tool 83. Maintenance of fluid pressure through the central passageway will maintain fluid pressure on displacement plug 107 thus exerting a downhole force on cement in the annulus between liner 13 and the wellbore. In this manner, sufficient pressure can be maintained on the cement to prevent the cement from backflowing or "u-tubing" into liner 13 prior to the setting of the cement.

Once liner packer 67 is set, as shown in FIG. 4C, drill pipe 26 (FIGS. 7A and 8A) can pull up on running tool assembly 79 shearing upper shear screws 91 and moving actuation ring 99 upward relative to dog 95 as shown in FIG. 4D. Continued upward movement can bring recess 101 adjacent to dog 95, allowing dog 95, biased to a radially inward position, to pull into recess 101, thereby releasing running tool assembly 79 from liner top packer 67, while maintaining the set of liner packer 67 as shown in FIG. 8B. Once released, the operator can pull running tool assembly 79 upward a short distance with drill pipe 26. This can move the running tool assembly 79 upward relative to the packer and cementing assembly 35, indicating to the operator that running tool assembly 79 is released from packer and cementing assembly 35.

The operator can then pull drill string 26 upward again a distance sufficient to place the lower end of stinger 105 above two-way check valve 43. This upward movement causes stinger 105, which previously was holding flappers 45 and 47 (FIGS. 3C and 7C) in the open position, to move above flappers 45 and 47. Flappers 45 and 47 may then close as shown in FIG. 3A. This closed position prevents any upward flow of fluid in the event cement in the annulus leaks past latching plug 107 (FIG. 8G). The closure of flappers 45, 47 also prevents any downward flow of fluid below two-way check valve 43. The barrier created allows the operator to pump a cleaning fluid, such as water, downward and out the lower end of stinger 105 where the cleaning fluid then flows back up the annulus surrounding drill pipe 26. This fluid flow can clean liner top packer 67 and tie back sleeve 77 of cement and debris. The flow may also be reversed down the annulus and up through drill pipe 26 to remove debris off of the top of liner string 13.

In the event displacement plug 107 fails to latch in bottom sub 15, running tool assembly 79 may be cleaned following removal of stinger 105 from two-way check valve 43. Two-way check valve 43 will prevent flow of fluid uphole past two-way check valve 43, thereby maintaining cement in the annulus between liner string 13 and the wellbore (not shown). In addition, two-way check valve 43 will prevent flow of fluid used to clean running tool assembly 79 past two-way check valve 43, thereby preventing movement of cement from the desired position within the annulus between liner string 13 and the wellbore.

After cleaning, running tool assembly 79 can be pulled up, except for latching plug 107, which remains latched at the lower end of liner string 13. After retrieving running tool assembly 79, the well can be completed by lowering a string with a drill bit into the casing 11. The drill bit is employed to drill through the two-way check valve 43, which is made up of easily drillable components. This disintegration of two-way check valve 43 thus opens the cemented liner string 13 down to latching plug 107. If desired, the operator may wish to drill out the latching plug 107, which may also be formed of drillable materials; the operator then may complete the well in any suitable manner.

Accordingly, the disclosed embodiments provide a means to set a liner top packer and release a running tool that operates equally well in the event of displacement plug failure. In addition, unlike other prior art methods, the disclosed embodiments provide an apparatus that allows the liner top packer to be tested following setting by closing a hydril against the drill pipe and testing the pressure above the liner top packer to determine if the packer was properly set. Furthermore, the disclosed embodiments, provide a packer cementing and setting apparatus that may use either a conventional displacement plug or a latching type displacement plug.

While the invention has been shown or described in only some of its forms, it should be apparent to those skilled in the art that it is not so limited, but is susceptible to various changes without departing from the scope of the invention.

What is claimed is:

1. A packer setting tool for use with a running tool, the packer setting tool comprising:

a tubular release body mounted on an end of the running tool and insertable into a wellbore;

an annular dog sub supported within the wellbore that circumscribes a portion of the release body and linked to the release body with a shear screw;

a thread on an outer surface of the release body engaged with a thread on an inner surface of the dog sub to define a threaded connection; and a tubular adapter sleeve mounted on an outer surface of the release body and having an end configured to interfere with a packer assembly, so that when the running tool rotates, the thread on the release body rotates with respect to the thread on the dog sub to drive the release body in an axial direction that fractures the shear screw and urges the adapter sleeve against the packer assembly to set the packer assembly;

an actuation ring circumscribing the tubular release body, wherein the inner surface thread of the dog sub is an inner surface of the actuation ring; and at least one do secured to the actuation ring with a shear screw so that when the running tool pulls axially upwards the shear screw fractures and the at least one dog urges radially inward into a dog recess defined in an outer surface of the actuation ring to release the dog sub from the packer assembly.

2. The tool of claim 1, wherein the threads comprise coarse multiple start threads.

3. The system of claim 1, wherein the dog has a plurality of ribs on an outer diameter surface of the dog so that the dog may engage a top of the packer assembly.

4. A system for cementing a liner string suspended from an end of a wellbore casing string by a liner hanger, and setting a liner top packer in the casing string above the liner hanger, the system comprising:

a running tool defining a central bore for passage of cement and drilling mud, the central bore having an axis;

a packer setting tool coupled to the running tool so that rotation of the running tool will actuate the packer setting tool to set the liner top packer with the running tool and upwards axial pull will actuate the packer setting tool to release the packer setting tool from the liner top packer;

the liner top packer releasably mounted to the packer setting tool at an upper end of the liner top packer;

a double flapper valve coupled to a lower end of the liner top packer so that after removal of the packer setting tool from the well bore the double flapper will prevent fluid flow in two directions through the valve;

a tie back nipple coupled to a lower end of the double flapper valve and configured to engage a liner top;

a tubular release body mounted on an end of the running tool and insertable into a wellbore;

an annular dog sub supported within the wellbore that circumscribes a portion of the release body and linked to the release body with a shear screw;

a thread on an outer surface of the release body engaged with a thread on an inner surface of the dog sub to define a threaded connection;

a tubular adapter sleeve mounted on an outer surface of the release body and having an end configured to interfere with the liner top packer, so that when the running tool rotates, the thread on the release body rotates with respect to the thread on the dog sub to drive the release body in an axial direction that fractures the shear screw and urges the adapter sleeve against the liner top packer to set the liner top packer;

an actuation ring circumscribing the tubular release body, wherein the inner surface thread of the dog sub is an inner surface of the actuation ring; and at least one dog secured to the actuation ring with a second shear screw, so that when the running tool pulls axially upwards the second shear screw fractures and the at least one dog urges radially inward into a dog recess defined in an outer surface of the actuation ring to release the dog sub from the liner top packer.

5. The system of claim 4, wherein the threads comprise course multiple start threads.

6. The system of claim 4, wherein the dog has a plurality of ribs on an outer diameter surface of the dog so that the dog may engage a top of the liner top packer.

7. The system of claim 4, wherein the double flapper valve comprises:

a tubular central body having a central passage;

an upper flapper having an open and a closed position, the upper flapper hinged to the tubular central body to allow flow through the central passage in the open position and prevent flow through the central passage in a first direction in the closed position; and a lower flapper having an open and a closed position, the lower flapper hinged to the tubular central body to allow flow through the central passage in the open position and prevent flow through the central passage in a second direction in the closed position.

8. The system of claim 7, wherein the running tool further comprises:

a stinger passing through the central bore of the tubular central body, so that the stinger will maintain the upper and lower flapper valves in the open position during the cementing process; and a cement plug releasably coupled to an end of the stinger and configured to release from the stinger in response to hydraulic pressure and land in the liner, so that fluids axially below the cement plug will not pass through the central bore to an area axially above the cement plug.

9. The system of claim 4, wherein the tie back nipple comprises:

a tubular member having a central passage;

a plurality of seals located on an outer diameter surface of the tubular member; and the seals are configured to engage a polished bore receptacle at an upper end of the liner.

10. The system of claim 9, wherein the tie back nipple further comprises a latch on a lower end of the tie back nipple engaged to an upper end of a liner hanger.

11. A system for cementing a liner string suspended from an end of a wellbore casing string by a liner hanger, and setting a liner top packer in the casing string above the liner hanger, the system comprising:

a running tool defining a central bore for passage of cement and drilling mud, the central bore having an axis;

a packer setting tool coupled to the running tool so that rotation of the running tool will actuate the packer setting tool to set the liner top packer with the running tool and upwards axial pull will actuate the packer setting tool to release the packer setting tool from the liner top packer;

the liner top packer releasably mounted to the packer setting tool at an upper end of the liner top packer;

a double flapper valve coupled to a lower end of the liner top packer so that after removal of the packer setting tool from the well bore the double flapper will prevent fluid flow in two directions through the valve; and a tie back nipple coupled to a lower end of the double flapper valve and configured to engage a liner top;

a tubular body defining a central passage having an inner diameter greater than the outer diameter of the running tool;

the tubular body having left hand threads on an upper inner diameter end of the tubular body, the left hand threads engage a dog sub of the packer setting tool, so that the packer setting tool will retain the liner top packer during running and setting of the liner top packer by the running tool;

a tie back sleeve circumscribing the exterior diameter of the upper end of the tubular body;

the upper end of the tie back sleeve abutting a lower end of an adapter sleeve of the running tool so that the adapter sleeve may exert a downward axial force on the tie back sleeve in response to rotation and downward axial force by the running tool;

at least one tubular packer element surrounding a lower end of the tubular body, the packer element having a sealed and an unsealed position;

an annular upward facing shoulder coupled to a lower end of the tubular body axially below the packer elements; and a setting assembly circumscribing the outer diameter of the tubular member interposed between the tie back sleeve and the packer elements and linked to the tie back sleeve with a shear screw, so that when the running tool exerts a downward axial force, the shear screw fractures and the tie back sleeve urges the setting assembly downward and compresses the packer elements between the upward facing shoulder and the setting assembly, thereby engaging the packer elements with the casing string.

12. The system of claim 11, wherein the setting assembly comprises:

a setting sleeve circumscribing a portion of the upper end axially below the tie back sleeve;

the setting sleeve having a plurality of teeth on an inner diameter surface and an upper end of the setting sleeve engaged to a lower end of the tie back sleeve;

an annular ratchet element interposed between the setting sleeve and the tubular body;

the annular ratchet element having a plurality of teeth on an outer diameter surface, the plurality of teeth matching and engaging the teeth of the setting sleeve;

the ratchet element having a plurality of teeth on an inner diameter surface, the plurality of teeth engaging corresponding teeth on an outer diameter surface of the tubular body, so that the teeth will engage in response to downward axial force on the setting assembly and prevent upward motion of the setting assembly;

a plurality of slips circumscribing a portion of the tubular body axially beneath the setting sleeve and having an upward facing shoulder configured to abut a downward facing shoulder of the setting sleeve and move axially downward over a ramp member in response to downward axial movement of the setting sleeve;

the ramp member circumscribing a portion of the tubular body axially beneath the plurality of slips and having a ramped surface proximate to the plurality of slips and a downward facing shoulder abutting the packer element, so that the slips will move into engagement with the casing string in response to downward movement of the slips over the ramped surface, while the ramp member moves axially downward in response to downward movement of the slips, thereby compressing the packer elements against the upward facing shoulder and into the set state in sealing engagement with the interior diameter surface of the casing string.

13. A method for cementing a liner string suspended from an end of a wellbore casing string by a liner hanger, and setting a liner top packer in the casing string above the liner hanger, the method comprising:

(a) running a running tool assembly having a running tool, a packer setting tool, a liner top packer in an unset position, a double flapper valve in an open position, and a tie back seal nipple into engagement with a liner top;

(b) pumping cement through the running tool assembly into a liner annulus between the liner and a native formation;

(c) pumping a displacement plug down the running tool assembly;

(d) setting the liner top packer by rotating the running tool assembly relative to the packer setting tool while maintaining a downward force on the liner top packer;

(e) removing the running tool and the packer setting tool; then (f) moving the double flapper valve to a closed position;

wherein step (d) comprises:

exerting a downward force on the liner top packer;

shearing a lower shear element securing the packer setting tool to the running tool;

rotating the running tool, thereby rotating through an internal thread linking the packer setting tool to the running tool; then exerting a downward force on the liner top packer with the running tool while rotating the running tool to move the liner top packer from the unset to the set position, and wherein step (e) comprises:

lifting up on the running tool assembly;

shearing an upper shear element maintaining engagement between the packer setting tool and the liner top packer; then moving an engaging sub of the packer setting tool to a disengaged position, thereby releasing the packer setting tool from the liner top packer.

14. The method of claim 13, wherein exerting a downward force on the liner top packer with running tool comprises:

the running tool exerting the downward force on a setting sleeve of the liner top packer;

moving the setting sleeve axially downward in response to downward force of the running tool;

moving slips over a ramp surface in response to downward movement of the setting sleeve to engage the slips in the casing string; then radially expanding packer elements into engagement with the casing through compression of the packer elements between the ramp surface and an upward facing shoulder of the liner top packer in response to downward movement of the slips.

15. The method of claim 13, wherein step (d) further comprises circulating fluid through the running tool assembly against the wiper plug during setting of the liner top packer so that the wiper plug holds cement in position within the liner annulus between the liner and the native formation.

16. The method of claim 13, wherein step (f) comprises removing a stinger of the running tool assembly from a central passage of the double flapper valve, so that upper and lower flappers of the double flapper valve return to the closed position.

17. The method of claim 16, wherein the method further comprises cleaning the running tool assembly by circulating fluid down the casing string above the double flapper valve while the double flapper valve prevents flow of fluid uphole.

* * * * *